United States Patent [19]

Geiger

[11] Patent Number: 4,730,789

[45] Date of Patent: Mar. 15, 1988

[54] AGITATOR MILL

[75] Inventor: Armin Geiger, Bichwil, Switzerland

[73] Assignee: Gebruder Buhler AG, Uzwil, Switzerland

[21] Appl. No.: 552,756

[22] Filed: Nov. 17, 1983

[30] Foreign Application Priority Data

Dec. 10, 1982 [DE] Fed. Rep. of Germany ..... 3245825

[51] Int. Cl.[4] ..... B02C 17/16

[52] U.S. Cl. ..... 241/69; 241/172; 241/171

[58] Field of Search ..... 241/65, 66, 67, 33, 241/171, 172, 46.11, 46.17, 175, 135, 137, 37, 79.3, 79.2

[56] References Cited

U.S. PATENT DOCUMENTS

| | | | |
|---|---|---|---|
| 3,256,070 | 6/1966 | Trickey | 241/171 X |
| 3,307,792 | 3/1967 | Hughes et al. | 241/172 X |
| 3,311,310 | 3/1967 | Engels et al. | 241/171 X |
| 3,529,780 | 9/1970 | Wilkinson, Jr. | 241/171 X |
| 3,653,600 | 4/1972 | Schold . | |
| 3,814,334 | 6/1974 | Funk | 241/79.3 X |
| 4,108,385 | 8/1978 | Funk | 241/172 X |
| 4,117,981 | 10/1978 | Engels | 241/79.3 X |
| 4,134,557 | 1/1979 | Lazzari et al. . | |
| 4,174,074 | 11/1979 | Geiger . | |
| 4,175,871 | 11/1979 | Suh et al. . | |
| 4,206,879 | 6/1980 | Geiger . | |
| 4,303,205 | 12/1981 | Geiger et al. | 241/171 X |
| 4,394,981 | 7/1983 | Schold | 241/172 X |

FOREIGN PATENT DOCUMENTS

| | | | |
|---|---|---|---|
| 1105258 | 4/1961 | Fed. Rep. of Germany | 241/175 |
| 2110336 | 9/1972 | Fed. Rep. of Germany | 241/172 |
| 2240751 | 2/1974 | Fed. Rep. of Germany . | |
| 2360920 | 6/1974 | Fed. Rep. of Germany . | |
| 1507653 | 9/1974 | Fed. Rep. of Germany . | |
| 2026733 | 6/1978 | Fed. Rep. of Germany . | |
| 2030179 | 1/1979 | Fed. Rep. of Germany | 241/172 |
| 3038794 | 5/1982 | Fed. Rep. of Germany . | |
| 1337238 | 8/1963 | France . | |
| 2014753 | 4/1970 | France . | |
| 2015544 | 4/1970 | France . | |
| 140656 | 3/1980 | German Democratic Rep. | 241/172 |
| 132086 | 3/1929 | Switzerland . | |
| 518128 | 3/1972 | Switzerland . | |
| 1302932 | 1/1973 | United Kingdom . | |
| 1325835 | 8/1973 | United Kingdom . | |
| 1491279 | 11/1975 | United Kingdom . | |
| 1486793 | 9/1977 | United Kingdom . | |
| 1547703 | 6/1979 | United Kingdom . | |
| 2074895 | 11/1981 | United Kingdom | 241/172 |

*Primary Examiner*—Mark Rosenbaum

*Attorney, Agent, or Firm*—Merchant, Gould, Smith, Edell, Welter & Schmidt

[57] ABSTRACT

An agitator mill has an arrangement for diminishing the pressure of the attritive elements towards the outlet. This arrangement comprises particularly means for generating a force pointing away from at least one separator opening forming a passage for the product, but retaining the attritive elements within the milling container. This force affects substantially selectively only the attritive elements. According to one embodiment, this force acts upon the attritive elements in counter-direction to the direction of flow of the product. The force may either be a centrifugal force acting selectively onto the relative large mass of the attritive element or a magnetic force acting selectively upon steel balls, iron balls or the like used as attritive elements. According to a further embodiment the separator opening is defined exclusively by surfaces of a rotary body in order to generate a centrifugal force, with this opening having a larger cross-section than the corresponding maximum size of the attritive elements. The separating device may have a rotary body within the range of a device for varying the volume of the milling container and therewith the pressure of the attritive elements therein. This rotary body may be supported by the piston of said varying means.

34 Claims, 23 Drawing Figures

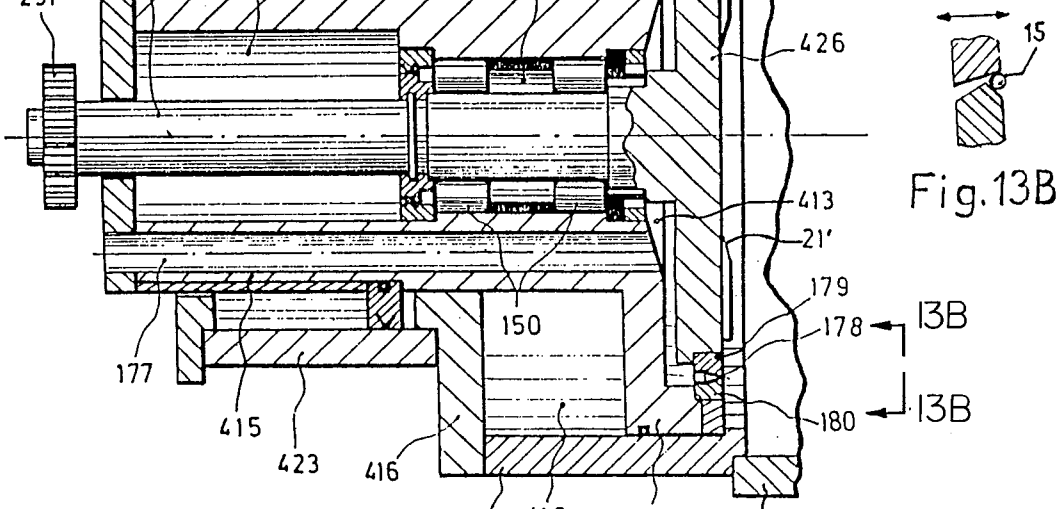
Fig.13B
Fig.13
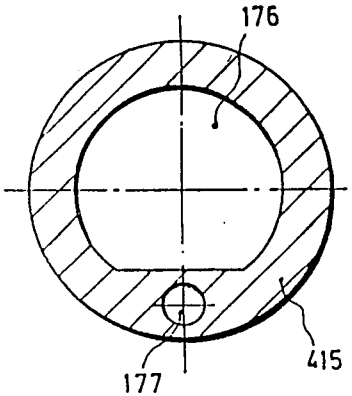
Fig.13A

AGITATOR MILL

FIELD OF THE INVENTION

This invention relates to agitator mills having an inlet and an outlet for the product suspended in a fluid which normally is constituted by a liquid. However, it is also known to use a gaseous stream as a fluid. The agitator for moving attritive elements which may either be in the form of balls made of steel, glass or other material, or may be constituted by sand or other irregularly shaped bodies. In order to retain these attritive elements within the milling room, at least one separating device has to be provided. The separating device will have at least one separator opening forming a passage exclusively for the fluid and the product suspended therein.

BACKGROUND OF THE INVENTION

In agitator mills the product generally is introduced into the milling container in the form of a suspension, flows then through the milling room during the milling operation and passes at the other end of the milling room via an outlet separator to an outlet chamber. This fluid flow also acts, of course, upon the attritive elements provided in the milling container. Even if the agitator mill is vertically arranged, the product thus flowing from below to the top through the milling container, and hence opposite to the force of gravity acting on the attritive elements, the gravity force is not sufficient to keep the attritive elements away from the separator opening. On the contrary, the elements are entrained and exert an undesirable pressure in the region of the outlet separator device. In order to obviate the unequal distribution of pressure connected therewith, it has been proposed to shorten the overall height of the milling container so that the difference of height between the inlet and outlet of the milling container is reduced. In this way the milling capacity of the mill has also been reduced and this proposal has not proved a great success. Furthermore, it has been proposed in the French Specification No. 2 015 544 to use a milling container of frustoconical shape with the inlet at the smallest end of the cone. This construction leads on the one hand to a certain improvement, on the other hand in the proposed form the particulate product is unequally treated as a consequence of varying residence or dwell times.

Agitator mills have also been proposed in German Specification Nos. 1 507 653 and 2 026 733 in which a kind of feeding screw generates a counter-pressure which provokes a downwardly directed conveying flow in the center of the milling container. As a result of this flow, the attritive elements are entrained downwardly near the screw, but outside the screw the suspended product flows upwardly so that an extremely unequal spectrum of the residence or dwell times will result.

A further problem is that the customary separating devices are unsatisfactory in some respects. By using sieve-screens there is the drawback that the openings of such screens will be clogged after a short time of operation. Therefore, slot-like separator openings have been proposed between fixed and moving surfaces or between two moving surfaces. Such areas, however, are mostly subjected to considerable wear and are thus destroyed in a short time.

East German Patent Specification No. 140 656 proposes effecting separation by arranging a rotary body opposite to a fixed wall defining the outlet opening. This rotary body causes a force which acts on the attritive elements in a radially outward direction. However, attritive elements moving along the wall of the milling container are free from the action of this centrifugal force and are, on the contrary, subjected to the pressure from below which increases towards the outlet opening and moves the elements along the fixed wall towards the outlet opening. Thus, it has not been proved possible to achieve unobjectionable separation with such an arrangement, so this proposal found no acceptance in practice.

A further problem resides in the accommodation of a separating device in agitator mills of the type which are provided with means for varying the volume of the milling room. In a known agitator mill (German Specification No. 22 40 751) the inlet for the product is formed by a central tube extending from the bottom until near the agitator where it is held and connected to the milling container (stator) by radial spokes. The piston of the varying means has a central bore with which it slides along the tube. The disadvantage is that above the orifice of the tube the spokes and the tube itself provide a quiet or calm region where product to be ground and grinding elements can accumulate without taking part in the milling operation. Moreover, when the piston moves to its highest position, it is readily possible for grinding elements to jam between the piston and the spokes whereby damage may occur. Moreover, the removal of lumpy bulks after a period of inoperation is difficult.

Furthermore, an agitator mill is known from German Specification No. 2 051 003 in which a cylinder of restricted diameter is connected to the bottom of the stator, and a vertically movable piston is arranged within said cylinder. The inlet for the product is above the orifice of the cylinder so that in this construction there is also a calm or quiet region above the piston in which the grinding elements are substantially stationary. The geometrical arrangement is such that in operation the mixture of fluid, suspended product and attritive elements is always flowable, however an accumulation of dried product and grinding elements can only be broken up with difficulty. In this case also the supply of new fluid suspended product is of no assistance in breaking up such an accumulation, because of the arrangement of the inlet above the cylinder which results in the formation of a calm or quiet region, as mentioned above.

An agitator mill is also known from U.S. Pat. No. 4,206,879 in which the displacing piston is combined with an inlet separator by providing either a peripheral slot between the piston and the wall of the container or by providing sieve openings in the piston itself. As mentioned above, such small openings tend to clogging and may become blocked.

German Specification No. 2 360 920 describes the separation of product and attritive elements at the inlet side by a swan-neck tube branching from the bottom opening of the milling container. However, it does not suggest any way of combining the swan-neck tube with the displacing piston.

SUMMARY OF THE INVENTION

It is an object of the invention to keep the attritive elements away from the respective separator opening in an unobjectionable manner.

With this object in view, the present invention provides means which diminish the pressure of the attritive elements either by selectively subdividing the milling room or by generating a counter-force. As will be subsequently explained, this counter-force may be any force adapted to act substantially selectively upon the attritive elements, i.e., a magnetic force in the case of steel balls or the like, or more generally a centrifugal force.

This principle may either by applied to the agitating mill itself (or to an arrangement of a plurality of agitating mills) or to the separation device only which separates the product from the attritive elements. Also, a combination is possible, e.g., by selectively making use of a suitable subdivision of the milling room and of a centrifugal counter-force.

A further object of the present invention is to provide an agitator mill having the advantages of an inlet at the front surface of a displacement piston facing the milling room but avoiding clogging problems during passage of the product through the piston as well as the possibility that grinding elements could enter into the cylinder behind the piston.

In order to solve this problem, the piston is interconnected with the separating device via connecting means, so that the piston itself no longer forms a sieve-like separating means, but may cooperate with the separating device to which it is connected. The connection may be effected by a tube, if the separating means is outside the milling container, particularly if a swan-neck tube is used. Alternatively, the connection may be in the form of bearings for a rotary separator. This also has the advantage that the separator is not affected by the vibrations of the agitator.

BRIEF DESCRIPTION OF THE DRAWINGS

FIG. 13 shows a further embodiment of a rotary separation device supported by a volume varying piston;

FIG. 13A is a section through the cylinder 423 of FIG. 13, and

FIG. 13B a detail in enlarged scale;

FIGS. 15A, 15B show two relative positions of agitator and stator in detail, whereas

In the figures the same numerals have been used for parts having the same function, but in some cases a letter or a hundred has been added.

Figure 1:
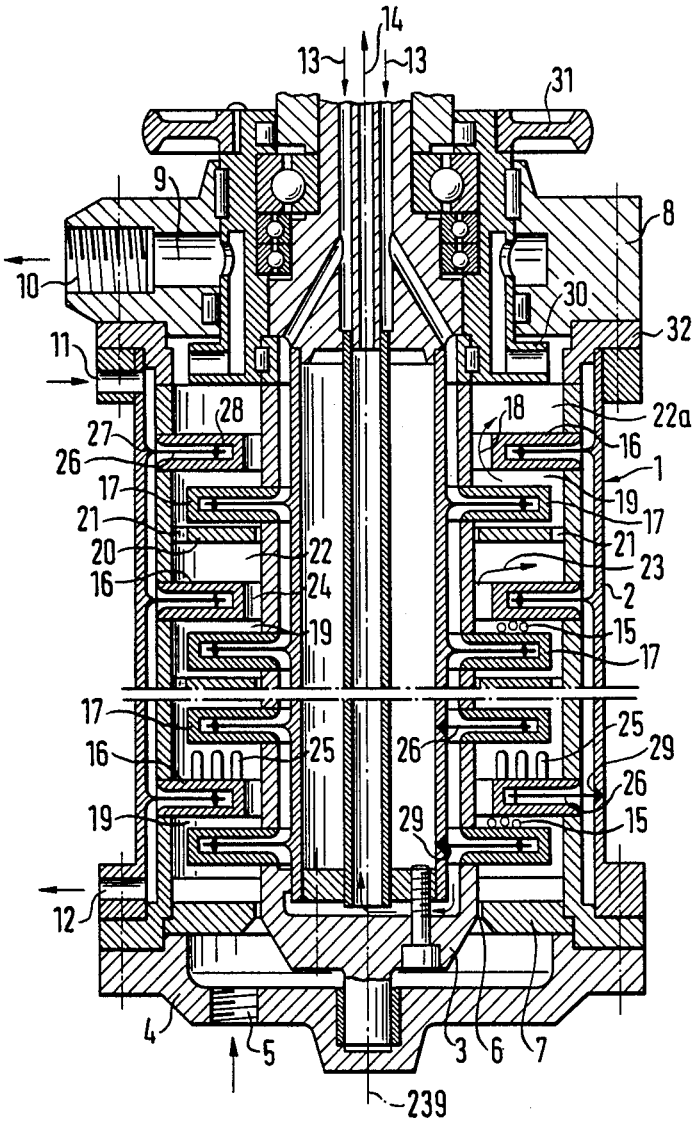
FIG. 1 is a cross-sectional view of an agitator mill showing three different types of tools in the upper part and at both sides of the center line of the lower part.

Referring firstly to FIG. 1, an agitator mill 1 has as usual a milling container 2. A journalled rotor of an agitator 3 extends into the milling container. The agitator 3 is driven in usual manner (not shown) at its top with reference to FIG. 1. Below the milling container 2 is an inlet casing 4 with an inlet bore 5. The product to be milled is suspended in a fluid and is pumped into the interior of the milling container 2 via this inlet bore 5. Below the agitator 3 is a separator plate 7 forming an inlet slot opening 6. This inlet or separator slot opening 6 prevents the attritive elements, particularly balls, from entering into the inlet casing 4 from the interior of the milling container 2.

A product outlet casing 8 is mounted by screws at the top of the milling container 2 and defines a product outlet chamber 9. An outlet bore 10 leads out from said chamber 9. The milling container 2 and/or the agitator 3 are double-walled in order to remove the frictional heat produced during milling operation. To this end, the milling container 2 has an inlet 11 and an outlet 12 for a cooling medium, whereas the cooling medium for the agitator is supplied over a double-hollow shaft in accordance with the arrow 13, and is discharged along the axis 239 of the mill in accordance with the arrow 14. All parts described above are known per se.

As already mentioned, grinding balls are generally provided in the milling container 2, some of which are shown in FIG. 1 (see the balls 15 at right). Independently of whether the attritive elements 15 are formed by balls, sand particles or the like, they have the tendency to migrate with the flow of the product suspension to the top whereby the pressure exerted by the attritive elements 15 is increased in undesirable manner just within the range of the transition from the top of the milling container 2 to the outlet casing 8. In order to obviate this inconvenience, the arrangement described further below is provided.

Disk-like milling and agitating tools are provided within the milling container 2. More specifically stator tools 16 mounted onto the milling container 2 and formed by hollow annular disks surround the agitator 3 with an interspace there between, whereas disk-like rotor tools 17 are provided at the outside of the agitator between the respective stator tools 16.

According to the embodiment shown in the upper part of FIG. 1, a narrow section 19 of the milling room is provided below the stator disks 16 and above the rotor disks 17 which section has an axial width insignificantly greater than the diameter of the balls 15. As may been from arrow 18, this narrow section 19 is passed through by a radially inwards directed flow of the product. In consequence of the relative great mass of the balls 15, they are subjected to a centrifugal force exerted by the agitator 3 and its tools 17, so that the balls 15 are driven radially outwards in counter-direction to the flow of product. Therefore, the balls 15 will concentrate at the inner wall of the milling container 2 under the pressure of the centrifugal force instead of being entrained by the fluid flow towards the outlet. It will be noted that the disk-like tools 16, 17 are each formed by two semicircular disk rings forming together the whole disk. When assembling the mill, one tool is mounted after the other, alternately fixing a stator tool 16 and a rotor tool 17.

A stator plate 20 is fixed to the inner wall of the milling container 2 close below one of the rotor disks 17, e.g., by welding. The stator plate surrounds the agitator 3 and has openings 21 in the form of slots or circular holes at its periphery. Some of the attritive elements 15 subjected to the pressure of the centrifugal force get through these holes into a smoothing room 22 defined on one side by the stator plate 20 and on the other side by the stator tool 16 arranged below it. Under the pressure of the centrifugal force in the section 19, but unaffected by the centrifugal force within the smoothing room 22, the grinding balls 15 may attain the outer surface of the agitator 3 which can again impart a radially outwardly directed motion to them, corresponding to the direction of the product flow (arrow 23). However, the surface speed of the agitator 3 at this place is, of course, smaller than at the periphery of the rotor disks 17. Moreover, the balls moving radially outwards are stopped by the grinding balls 15 pushing from above so that the motion is smoothed in total. Therefore, it is possible that the grinding balls may pass through an opening 24 between the annular stator disks 16 and the outer surface of the agitator 3 into the subjacent room section 19 where they are thrown again in counter-flow to the product.

Smoothing and braking of the motion of the balls can be effected in various ways. As an alternative, the stator tools 16 in the lower part of FIG. 1 have rod-like members 25, the stator plate 20 of the upper part of FIG. 1 being omitted.

It will be understood that the narrow dimension of the room sections 19 means that an especially high level of frictional heat has to be removed in this range. To this end, annular sheet-like partitions 26 are provided in the interior of the hollow stator disks 16 forming an inside wall and forcing the cooling water to stream through the interior of the stator disks 16. These partitions 26 are fixed, particularly soldered, by their outer perpheries on wall projections 27. In order to ensure an equidistance in the interior of the stator tools 16, the partitions 26 may be provided with nodular feet 28. A similar construction may be provided for the rotor tools 17 as shown.

Alternatively or additionally, the construction may be in accordance with the lower right side of FIG. 1 where the inner walls of the jacket of the double-walled milling container 2 has grooves 29 in which the partitions 26 may be inserted and fixed by cementing or by soldering. Equally, grooves 29 are provided at the periphery of the inner part of the agitator 3 in which the partitions 26 of the agitator, suitably in the form of two sectors, may be inserted and fixed in the manner described.

One particular feature is the outlet separator device of FIG. 1, formed by a kind of bucket wheel 30. As shown, this bucket wheel 30 is supported within the outlet casing 8 coaxial to the upper part of the rotary agitator 3, or to the drive shaft of the same, and is driven independently from the agitator 3 by a drive wheel 31 wedged thereon. Normally, driving motion will be imparted by a separate motor in a manner not shown. It is, of course, equally possible to provide a common motor for driving both the agitator 3 and the wheel 31 and to provide a suitable step-up gearing for driving the bucket wheel 30. In this way, the bucket wheel 30 may be driven with such a high speed that the attritive elements 15, having a high mass relative to the particles of the product, are moved in counter-direction to the product, i.e., radially outwards, from where they may arrive into a subjacent smoothing room **22*a*, suitably provided. Preferably, the speed of rotation of the bucket wheel 30 is variable and may be selected so that it meets the special requirements. This again may be effected by a suitable gearing or through electric means by selection of the motor speed. In any case, the rotary speed may be selected so that the grinding balls 15 are thrown outwards, but impinge onto the inner wall of the milling container after having been decelerated by the flow of product to such an extent as to prevent wear, such as usually occurs with separator slots and which often leads to a size reduction of the attritive elements in an undesirable manner. In order to ensure a suitable stopping distance, the upper part 32 of the milling container 2 may have an enlarged diameter relative to the embodiment shown in FIG. 1. In this case, one should avoid the milling container forming a room enlarged in steps within the region of the casing 32, which would enable the grinding balls to gather there. Therefore, an enlarged upper part 32 of the milling container 2 should be downwards conically convergent, and thus funnel-shaped, so that the grinding balls impinging onto the wall of the part 32 are guided downwards towards the smoothing room 22*a***.

If the product to be ground is often changed, it may be desirable to also change the arrangement counteracting the pressure of the attritive elements at the top, in order to meet the specific requirement. The parameters which have to be considered are the viscosity, the speed of flow or the pressure of the product suspension, and also the size of the attritive elements (in case this should change). In order to adapt the efficiency of the construction of FIG. 1, i.e., to vary the centrifugal forces acting upon the grinding balls 15, it is also conceivable that one could control the speed of revolution of the agitator 3, or vary the distances of the stator disks 16 and the rotor disks 17. The latter measure is, of course, only possible until a minimum width of the room sections 19 is reached, corresponding substantially to the diameter of the grinding balls 15. Proceeding from this extreme adjustment position, the action of the centrifugal force may be reduced by enlarging the annular room sections 19 by increasing the distances between the tools 16 and 17 defining these room sections. In principle, this may be effected manually by means of a device described later with reference to FIG. 4. Preferably, however, a control loop may be provided in accordance with FIG. 2, described as follows.

Figure 2:
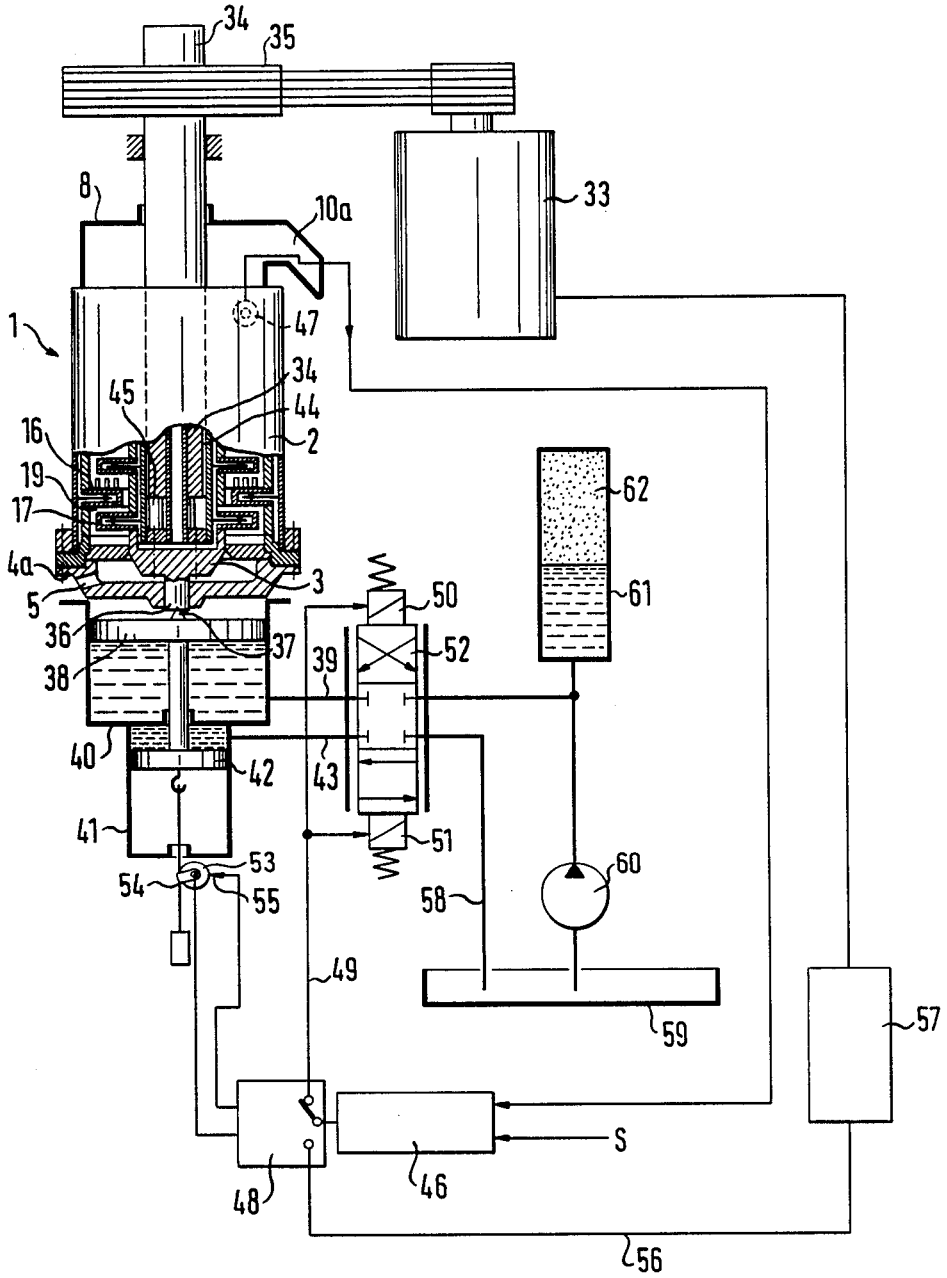
FIG. 2 represents the agitator mill of FIG. 1 in a control system.

In FIG. 2 only those parts of the agitator mill 1 are shown in detail which are of importance for the understanding of the function of the control loop. The drive motor 33, driving the drive wheel 35 mounted on the drive shaft 34, as well as the outlet casing 8 for the product together with the outlet **10*a*, are only schematically illustrated. The inlet casing 4*a* is modified with respect to the construction of FIG. 1 in that the inlet 5 is laterally arranged, and the lower stub shaft 36 of the agitator 3 has thrust bearing outside the milling container 2. This is schematically indicated by a conical bearing 37**.

The conical bearing 37 is situated on the front surface of a piston 38 which is movable upwardly from below by supplying hydraulic fluid through a conduit 39 to a cylinder 40. The movement in the counter-direction is achieved by urging an auxiliary piston 42 in a second cylinder 41 by means of hydraulic fluid supplied through a conduit 43. This arrangement is only an example for illustrating one possible way of producing an axial movement of the agitator 3, and may, of course, be replaced by technical equivalents. For instance, a lead screw may be driven by a motor, e.g., controlled by a Wheatstone bridge, or alternatively, a single double-acting piston may be provided in a cylinder with two pressure chambers on opposite sides of the piston, the piston rod projecting from the cylinder and supporting the thrust bearing 37. In the case of said Wheatstone bridge, one branch thereof may comprise a transducer resistance for the pressure of the attritive elements, but equally other comparing circuits may be used.

In order not to shift the drive shaft 34, but only to displace the agitator 3 in relation to the shaft 34, this shaft 34 is extended into the interior of the hollow agitator 3 and connected with the latter for common rotary motion, but is displaceable in an axial direction, e.g., by using teeth or other projections 44 which engage with counter-projections 45 inside the agitator.

For varying the width or height of the room sections 19, a control stage 46 is provided which may comprise a differential amplifier as the basic element. A nominal value signal S is fed to one inlet of this control stage 46 from setting means not shown, which may be manually settable, whereas the output signal of a pressure sensor 47, e.g., comprising a piezo-electric crystal, for sensing the pressure of the attritive elements 15 is supplied to the other inlet of the control stage 46.

In the simplest case, the output signal of the control stage 46 may be fed to a final control element either for the displacement of piston 38 or for the adjustment of the number of revolutions of the motor 33. However, in the embodiment illustrated, a switching stage 48 is provided at the output of the control stage 46 and is connected to a first outgoing line 49 by which two electromagnets 50, 51 can be energized for displacing a valve 52. To this end, the control stage 46 may comprise a threshold switch with a relative large hysteresis (adjustable, if desired) so that the solenoid 50 is energized when the difference of the input signals exceeds a first predetermined threshold value. In contrast, the solenoid 51 is energized when the difference of the input signals falls below a predetermined second (lower) threshold value. The valve 52 assumes a middle position, as shown, within the range of the hysteresis.

In this way, the displacement of the piston 38 and thus of the agitator 3 is controlled by the output signal of the control stage 46 in the illustrated position of the switching stage 48. The auxiliary piston 42 may be connected to a roller 53 so as to transmit its movement, said roller 53 having besides a central contact also a limiting contact strip 54. This limiting contact strip 54 is arranged in such a manner that it faces a wiper 55 in that position of the agitator 3 relative to the milling container 2 in which the room sections 19 have the smallest possible height in accordance with the above explanation. When the limiting contact strip 54 faces the wiper 55, the circuit to the central contact is closed, and the switching stage 48 receives a pulse to the effect that the output signal of the control stage 46 is fed to an outgoing line 56, until the circuit 54, 55 is opened again or the sensor 47 informs about a pressure drop. A control and adjusting stage 57 for adjusting the speed of rotation of the motor 33 receives the output signal of the control stage 46 via the line 56, so that in this arrangement the control by displacing the agitator 3 has priority. In fact, it is mostly desired to maintain the speed of revolution of the agitator 3 substantially constant. For special constructions, however, the control of the speed of revolution of the motor 33 may have priority, in which case a displacement of the piston 38 is only effected when a predetermined limit of the speed of revolution of the agitator is attained.

Figure 7:
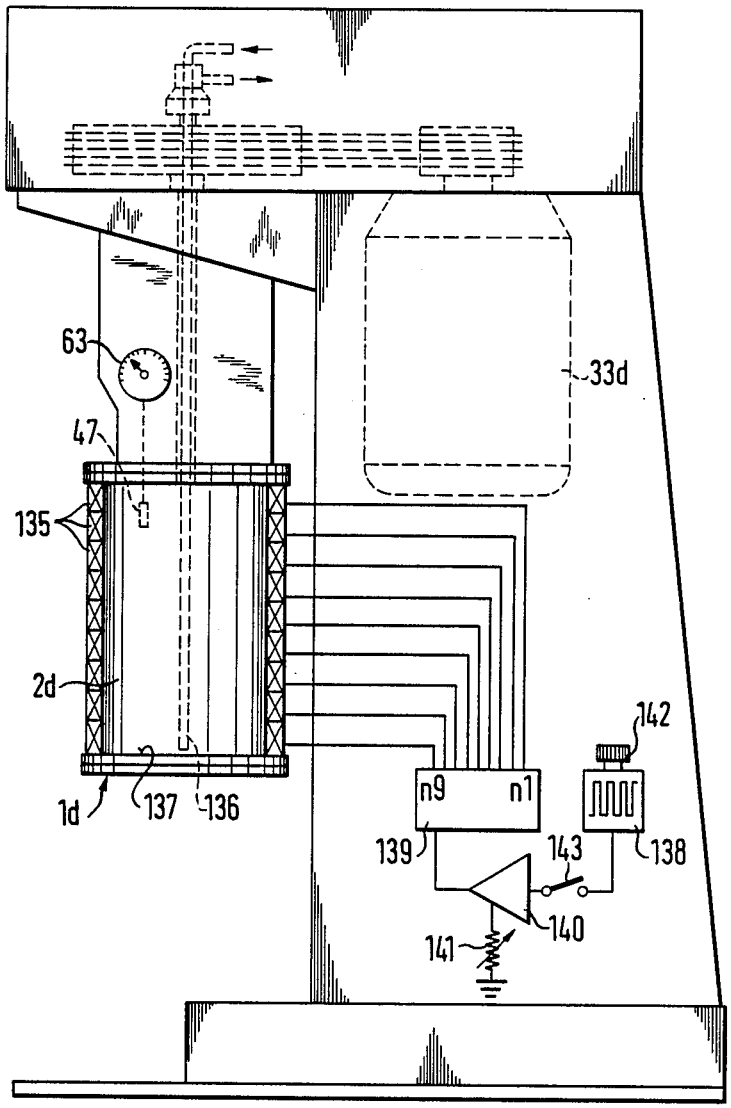
FIG. 7 is an alternative embodiment schematically illustrated.

Although the function of the valve 52 may be seen from the symbols shown, it should be mentioned that it is connected via an outlet conduit 58 to a tank 59 for a hydraulic fluid from which the hydraulic fluid may in turn be fed into a pressure tank 61 by means of a pump 60. A further pressure medium is provided in this pressure tank 61, e.g., a gas 62, suitably sealed, in a manner not shown, by a piston or an elastic diaphragm. In the extreme positions, the liquid is fed from the pressure tank 61 through the conduit 39 or the conduit 43 to one of the cylinders 40 or 41, respectively, whereas the respective other cylinder is connected to the outlet conduit 58, deviating from the middle position of the valve 52 shown. It has already been mentioned that manual adjustment is also possible instead of an automatic control of the type described later with reference to FIG. 4. Furthermore, it is also conceivable that the pressure sensor 47, in accordance with FIG. 7, is simply connected to an indicator 63, and that an operator accomplishes the displacement of the valve 52 (FIG. 2) or the adjustment of the speed of revolution of the motor 33 in accordance with the indication.

Figure 3:
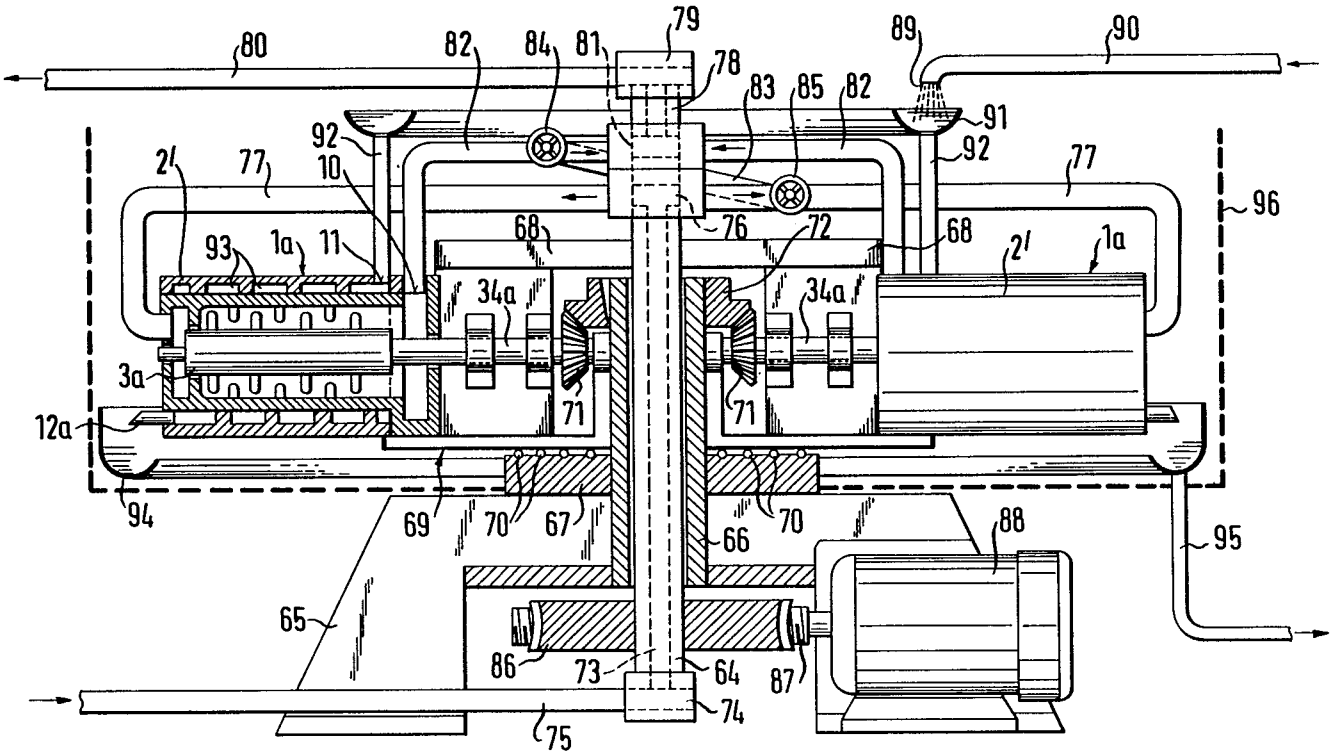
FIGS. 3–6 illustrate different embodiments of agitator mills mounted on a carousel shaft, FIG. 6 showing a detail of the drive.

From the foregoing it will be understood that the attritive elements 15 are biased towards the inlet in counter-direction to the flow of the product suspension by means of the centrifugal force which practically only acts on the attritive elements. Another realization of this principle is shown in FIG. 3. In this figure, two cylindrical agitator mills 1*a* are arranged on opposite sides of a carousel shaft 64. At this point it should be mentioned that suitably a plurality of agitator mills are regularly distributed over the circumference of this carousel shaft 64 so that, to some extent, a balance is achieved. The carousel shaft 64 is supported by a supporting frame 65 and in a journal 66 penetrating centrally a table 67. At its top, the carousel shaft 64 is connected to two arms 68 of a carousel carriage supported on the table 67 by ball bearings 70.

The agitator 3*a* of each agitator mill 1*a* has a bevel gear 71 on that side of its drive shaft 34*a* which faces the carousel shaft 64. All bevel gears 71 engage a crown wheel 72 rigidly wedged onto the outside of the journal 66 so that the bevel gears 71 roll upon the crown wheel 72 during rotation of the carousel shaft 64, thus executing a planetary motion. The respective agitator 3*a* is driven as a result of this planetary motion. In this way, the number of revolutions of the agitator 3*a* is in a fixed relationship to the number of revolutions of the carousel shaft 64, said relationship being only variable by changing the bevel gears 71, 72.

The carousel shaft 64 has in its interior a bore 73 extending from below nearly to the top. Said bore 73 is connected through a swivel joint 74 to a supply tube 75 for supplying the product suspension by means of a pump (not shown). The upper end of the bore 73 of the carousel shaft 64 serves as a supply channel and terminates in a cross bore 76 to which inlet tubes 77 for the inlet side of the radially outwardly disposed agitator mill 1*a* are connected.

In the upper part of the carousel shaft 64 is an outlet channel 78 discharging into a swivel joint 79 from which the fully ground product is let away through a conduit 80. The lower end of the outlet channel 78 is also in connection with a cross bore 81 to which outlet tubes 82 are connected. These outlet tubes 82 are in connection with the respective outlets 10 of the corresponding agitator mills 1*a*. In this way, all agitator mills 1*a* mounted on the carousel shaft 64 may be operated in parallel. Likewise, it is also possible to connect the agitator mills 1*a* in series so that the product runs through the mills one after another. To this end a connecting conduit 83 is provided which can be put into and withdrawn from service by valves actuated by handwheels 84, 85. Thus, handwheel 84 establishes a connection from the conduit 82 to the conduit 83 whereas the connection to the cross bore 81 is interrupted. In distinction, the handwheel 85 interrupts the connection between the conduit 77 and the cross bore 76 and establishes the connection to the conduit 83. The handwheels 84, 85 may be replaced by a device allowing the adjustment of both valves by a single operation in order to exclude errors. This can be done, for example, by means of appropriately switched solenoid valves.

A worm gear 86 is mounted on the lower part of the carousel shaft 64 for driving the carousel 64, 69 said gear 86 engaging a drive worm 86 on the shaft of a driving motor 88. Any other transmission for the rotation of the motor may also be used if desired. It may, in particular, be advantageous to provide a variable power transmission, if necessary a continuously variable power transmission, arranged between the motor 88 and the carousel shaft 64.

Figure 4:
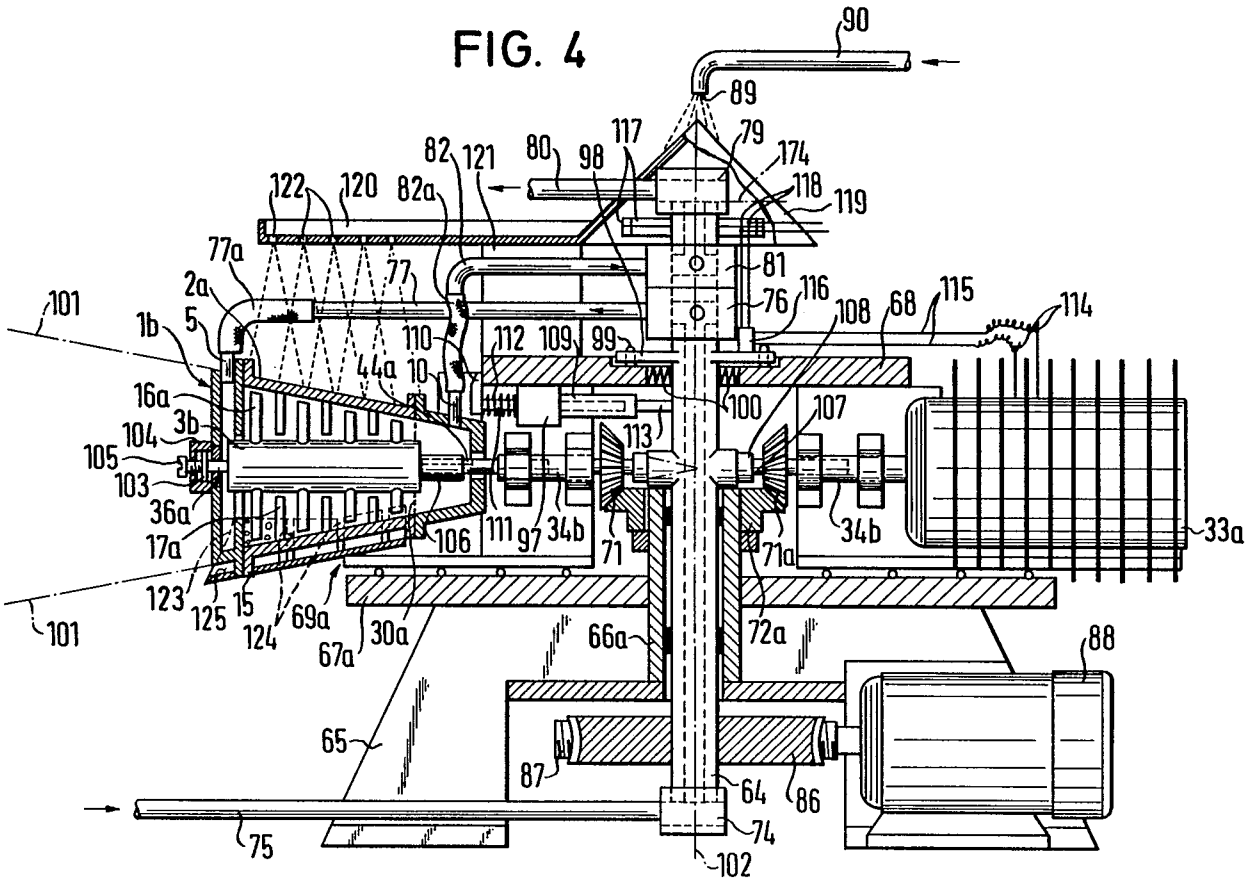

The supply of a cooling medium may represent a certain problem when mounting the agitator mills 1*a* upon a carousel 64, 69. This problem may be solved in the usual manner by machining a plurality of bores into the carousel shaft or by constructing it as a plurality of concentric hollow shafts, in each case using suitable swivel joints. FIG. 3, however, shows a constructionally simpler solution in which an orifice 89 of a water supply conduit 90 is provided above the plane of rotation of the agitator mills 1*a*. The orifice 89 is located above an annular water gutter 91 forming a collecting launder, from which water supply tubes 92 lead to the water inlet openings 11 of the agitator mills 1*a*. The water is distributed from the openings 11 without any further ado under the influence of the centrifugal force. For this reason it is favorable to provide cooling channels 93 helically wound around the milling container 2 in order to avoid the cooling water flowing away too quickly. The outlet 12*a* for the cooling medium is then suitably arranged parallel to the agitator shaft 34*a* and normal to the carousel shaft 64 so that the cooling water runs out under the action of the centrifugal force. The cooling water which flows out may be collected by a collecting gutter 94 forming another collector surrounding the carousel 64, 69. The cooling water is able to drain from this collecting gutter 94 either simply through a drain conduit 95, or it may be recycled to the supply conduit 90 by means of a pump. The carousel thus completed is suitably surrounded by a safety screen, only schematically indicated in FIG. 3. A modification of the embodiment of FIG. 3 is illustrated in FIG. 4. In this case, the carousel shaft 64 is supported within a bushing 66*a* by means of radial ball bearings whereas the thrust bearing is not shown and may be of any known construction.

The carousel shaft 64 has fork arms 98 at opposite sides of its top whereby the carousel carriage 69*a* is held radially movable (relative to the carousel shaft 64) by bolts 99, engaging the eye of the fork 98. Thus, the carousel carriage 69*a* is connected to the carousel shaft 64 for common movement, but is displaceable by a small amount to the left or the right (with reference to FIG. 4), whereby a respective one of two springs 100 is compressed or released. The purpose of this arrangement, which in practice allows a tumbler movement of the carousel carriage 69*a*, is described later.

On one side of the carousel carriage 69*a*, a drive motor 33*a* for at least one agitator mill 1*b* is provided. The arrangement is such that a certain balance is again achieved by the almost equal distribution of the masses over the circumference of the carousel shaft 64. Preferably, however, the motor 33*a* drives a plurality of agitator mills 1*b* by driving a crown wheel 72*a* by means of a driving bevel gear 71*a*, said crown wheel 72*a* being rotatably supported on the bushing 66*a* and driving the driving bevel gear 71 for the agitator mill 1*b*. In order to accommodate as many agitator mills as possible onto the carousel 64, 69*a* in a space-saving manner, the agitator mills may be of frustoconical shape, as represented, whereby suitably the generating lines 101 of the cone intersect each other at (or at least in the region of) the carousel axis 102. This conical construction may also have advantages with respect to the diminution of the pressure of the attritive elements within the range of the outlet separator device (sieve 30*a*), but it has already been mentioned that the danger of an unequal distribution of the residence time of the individual particles of the product arises, namely by the formation of a whirl torus within the milling container. It has however now been found out that in all cases where such a danger may exist (thus, not only in conical milling containers), it is of advantage to extend the rotor tools 16*a* until they lie near to the inner wall of the milling container and to extend the stator tools 17*a* until they lie near to the outer surface of the agitator 1*b*. In this way, the whirls are disturbed and thus are hindered from developing. As may be seen from some attritive of the elements 15 that are in FIG. 4, the slot remaining between the rod-like rotor tools 16*a* and the inner wall of the milling container 2*a* is smaller than the diameter, or the average diameter, of the grinding balls, and the same applies in analogous manner to the slot between the free ends of the rod-like stator tools 17*a* and the outer surface of the agitator 3*b*. If it is desired to vary the width of this slot, the stub shaft 36*a* may be supported by a thrust bearing 103 axially adjustable within a bushing 104 by means of an adjusting screw 105. In order to enable this adjustment, the drive shaft 34*b* is shouldered at the side of the agitator mill 1*b*, i.e., the shaft has a reduced diameter, whereas the agitator 3*b* is connected to a hollow-stub shaft 106 telescopically guided on the end of reduced diameter of the drive shaft 34*b*. In order to achieve a connection stiff against torsion, interengaging teeth or the like are again provided, a tooth 44*a* of which is indicated.

Since, as mentioned above, the carousel carriage 69*a* is radially displaceable with respect to the carousel shaft 64, it is also necessary to construct the larger diameter section of the drive shaft 34*b* telescopically, i.e., this section is hollow and receives in its interior a separate bevel gear shaft 107 which is connected for common rotary movement, but axially displaceable in a manner not shown. In this way, the bevel gear shaft 107 may be supported by thrust bearings 108 mounted on lateral projections of the carousel shaft 64, and may thus be held in an axially nondisplaceable manner.

It has been repeatedly mentioned that the carousel carriage 69a is radially displaceable relative to the carousel shaft 64 against the pressure of springs 100. This type of mounting of the carousel carriage 69a serves to enable self-balancing. For this purpose, means are provided forming a feedback loop in a manner known per se and comprising a counterbalance 97, which is only schematically illustrated and which is connected to a sleeve 109. The sleeve 109 slides on a rod 111 protruding from the bracket 110 and is biased by a pressure spring 112 to urge a follower pin 113 against the circumference of the carousel shaft 64. Thus, when a lack of equilibrium arises on the side of the motor 33a, for example as a consequence of different degrees of admission in the agitator mill 1b or the like, the carriage 69a is drawn to the right (with reference to FIG. 4), i.e., to the side of the higher weight, during its rotation on the table 67a. Thereby, however, the pin 113 is displaced to the left against the action of the spring 112 so that the counterbalance 97 comes to lie radially more outwards, thus increasing the counterforce at the left so that the imbalance is automatically equalized.

Although, in the embodiment shown, the parts 97, 109 and 113 are rigidly interconnected or even integrally formed so that a distinction of their function as a closed control circuit is hardly possible, and is thus merely described as a negative feedback loop, it will be readily understood that the pin 113 effectively represents a measuring and sensing element, the output signal of which (i.e., its movement) could also be transmitted to the counterbalance 97 in another way. For example, it could be appropriate to provide a step-up transmission between a measuring device corresponding to the pin 113 and the counterbalance 97 for increasing the shifting ratio. In this case, it will easily be recognized that the arrangement represents a control device as is known in various embodiments and realizations and on different machines such as on plan sifters, for balancing tires, etc. Merely as an example, the construction of the French Specification No. 1 337 238 should be mentioned, which is also applicable in suitably adapted form for the purpose of the present invention.

Since the carousel carriage 69a carries at least one drive motor 33a and is not only rotatable but also radially displaceable, the power supply to the motor has to be constructed accordingly. Thus, the supply lines 115 extend at least partly helically from the motor terminals 114, as schematically indicated, ensuring suitable compensation when the carousel carriage 69a is displaced. The supply lines 115 extend to a distributor box 116 and from there to two wipers 118 abutting on collecting rings 117. The collecting rings are connected to the electric-supply line through moisture isolated cables in a manner not shown. Moreover, the conduits 77, 82 are connected to the inlet 5 and the outlet 10, respectively, via hose couplings 77a and 82a to enable the displacement of the carousel carriage 69a. The conduits 77 and 82 are suitably mounted on a wall member 121 in a manner not shown.

In principle, the cooling of the agitator mill 1b may be constructed as illustrated in FIG. 3. However, in the modification shown in FIG. 4, the orifice 89 of the water supply conduit 90 is arranged above a distributor cone 119 which distributes the water received through tubes or gutters 120. The cone 119 is preferably connected to the carousel shaft 64 together with the gutter or gutters 120 for common rotary movement in order to ensure an optimal cooling efficiency. Each gutter 120 is situated in this arrangement above the corresponding agitator mill 1b. The water discharged from the orifice 89 flows downwardly along the distributor cone 119 and attains at last the radial outermost border of the respective gutter 120 simply due to the centrifugal force. Hole-type nozzles 122 are provided in the gutter 120 in spaced relationship through which the water can flow downwardly onto the outer surface of the agitator mill 1b. The agitator mill 1b is supported on the carousel carriage 69a by a base support 123 being substantially semicircular in cross-section in order to match the circumference of the agitator mill 1b, i.e., the diameter of this semicircle or arc decreases in correspondence with the taper of the milling container of the agitator mill 1b towards the carousel shaft 64. The base support 123, however, is not precisely in the form of a circular arc, but has arc-shaped grooves 124 permitting the water flowing along the circumference of the agitator mill 1b to run to the bottom. These grooves may be funnel-shaped at their upper end, if desired, and open below the agitator mill 1b into a water-gutter 125 embossed from the circular arc shape of the base support 123. The water running from the gutter 125 may either stream out freely or may drain into a collecting gutter such as 94 in FIG. 3 (not shown here). It should be mentioned that a support may also be suitably provided for the protruding gutter 120, as indicated by the supporting wall 121. It will, however, be understood that the support should be arranged as far radially outwards as possible, depending on the constructional restraints, in order to avoid vibrations.

It should also be mentioned that the conduit 80 in FIG. 4 is illustrated in the same manner as in FIG. 3 for the sake of simplicity. Actually however, the constructional circumstances of FIG. 4 are more complicated in some respects by virtue of the distributor cone 119. For this problem numerous solutions are imaginable: the distributor cone 119 may be divided along a dash-dotted line 174 so that the upper part is connected with the swivel joint 79, whereas the lower part is connected to the wall 121, the upper part overlapping the lower one. Alternatively, the swivel joint 79 may be arranged either below the distributor cone 119 or above it. In the latter case, the cooling water would flow over the upper surface of the swivel joint 79. Moreover, instead of the cone 119, a distributor bowl may be provided having outlet holes at its circumference. If desired, the gutter 120, in a further modification, may be rigidly held in which case the motor 33a together with the leads has to be covered or sealed.

In the embodiment of FIG. 2, the stub shaft 36 engages the conical bearings 37 under the proper weight of the agitator 3. In an alternative embodiment, biasing means of hydraulic or pneumatic type or also springs may be provided, and it is likewise possible to have a positive connection between the agitator 3 and the piston 38.

Figure 5:
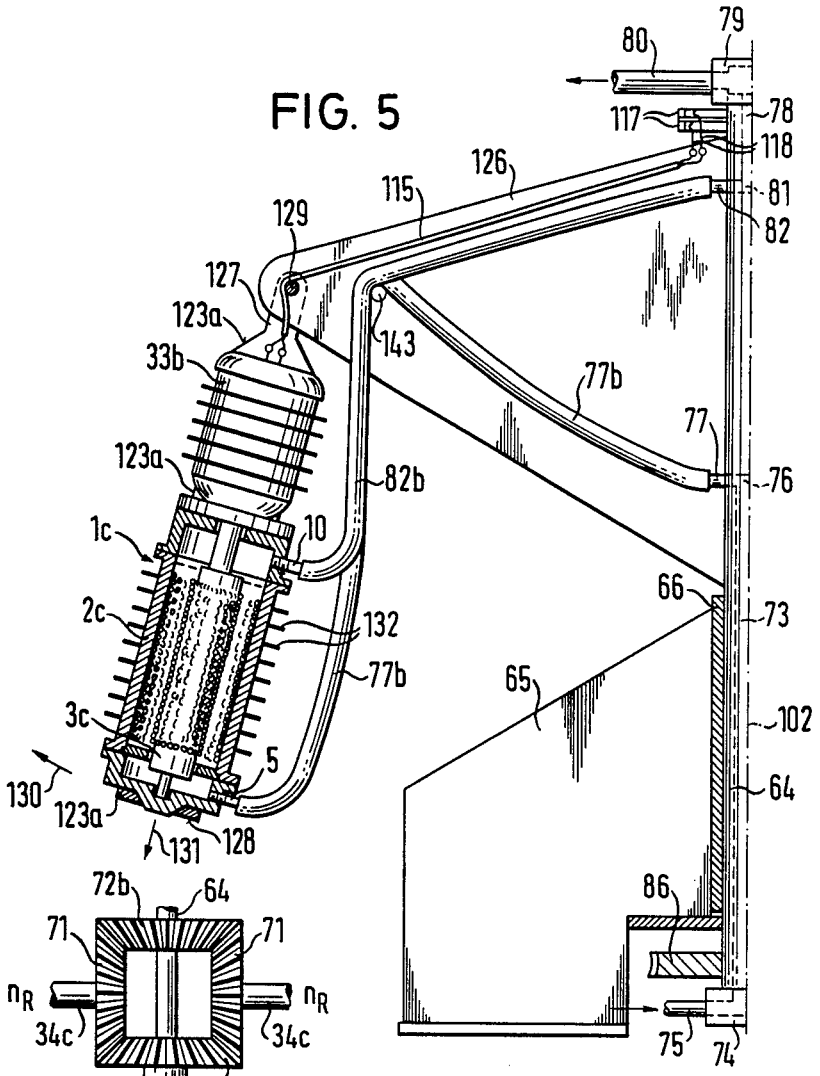
Figure 6:
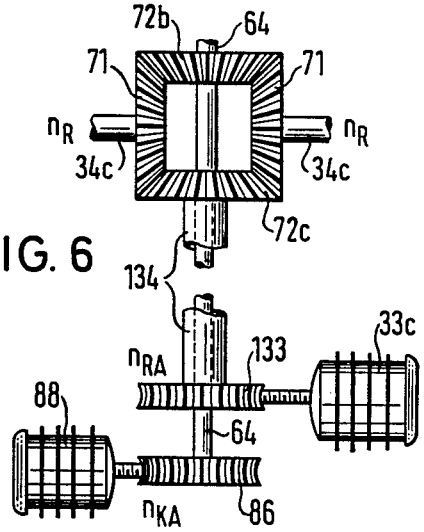

FIG. 5 shows another embodiment of a carousel of which only one half is shown for the sake of simplicity, so that the carousel shaft 64 is divided along the axis 102. However, instead of a support table 67, or 67a, the agitator mills 1c are in this case pivotally suspended on a supporting structure 126. The supporting structure 126 of FIG. 5 is represented as a plate, but preferably and alternatively the framework known from carousels may also be used. The drive for the carousel shaft 64 may be effected in a similar way by means of a worm gear 86 (as shown in FIGS. 3 and 4). Each agitator mill 1c is supported by a substantially U-shaped holder 123a having two legs 127 (only one is shown) parallel to each other between which the agitator mill 1c is arranged together with the drive motor 33c which is flanged to the agitator mill. Moreover, the agitator mill is held by the yoke portion 128 of the U-shaped holder 123a, with the yoke portion connecting both legs 127. The two legs 127 are supported on a pivot 129 mounted on the supporting structure 126.

During rotation of the carousel shaft 64, all agitator mills 1c mounted on that shaft 64 swing out under the action of the centrifugal force in the sense of the arrow 130. In comparison to the embodiments according to FIGS. 3 and 4, the advantage is achieved that the centrifugal force acts within the interior of each agitating mill 1c always in the direction of the axis of the milling container, or parallel to this axis, upon the attritive elements 15 (see FIG. 1), as indicated by the arrow 131, said elements being freely movable within the milling room surrounded by the milling container.

It will be understood that it is of advantage, with a pivotal support of the agitator mills 1c, for a separate drive motor 33b to be assigned to each agitator mill 1c, although a central drive would also be possible by means of universal joints. Since with this kind of support the drive motor 33b is rotatable and pivotable, the power line 115 is also connected in this embodiment to wiper contacts 118 sliding on sliding rings 117, mounted in a manner not shown, around the carousel shaft 64. In order that the smallest possible change of length of the line 115 is achieved, during pivoting of the holder 123a together with the drive motor 33b, in order to relieve this line from tension as much as possible, the line 115 is suitably put over the pivot 129. The inlet conduits and the outlet conduits for the agitator mills 1c are preferably formed in this embodiment by hoses 77b and 82b, respectively, extending at least over the larger section of the distance to the carousel shaft 64. These hoses 77b, 82b are connected to short tubes 77, 82 connected in turn to the channels 73 and 78, respectively, of the carousel shaft 64, as in the foregoing examples.

In principle, cooling of the agitator mills 1c may be effected without any further ado in a similar way to that described and illustrated with reference to FIG. 4. However, in the embodiment shown, radiating fins 132 are arranged on the outer surfaces of the agitator mill 1c to enlarge the area and to facilitate the removal of heat. In fact, by freely suspending the agitator mills 1c, they are exposed with their whole circumference to the air current produced during rotation of the carousel shaft 64 so that air cooling is realized in a particularly simple manner.

One problem arising in agitator mills is the high wear to which the inner surfaces of the milling container 2c which are exposed to friction are subjected. Above all, this is to be attributed to the fact that the grinding balls are relatively hard, especially if they are made of ceramics or steel. In the illustration of FIG. 5, the inner surface of the milling container 2c is covered with such hard balls of steel or sintered material as is the outer surface of the agitator 3c. The balls (or hemispheres) are fixed by cementing, soldering or the like. In principle, it is known from the field of space technology to cement hard materials in the form of small platelets onto the surfaces to be protected. However, in the present case, the balls or hemispheres have the advantage of provoking a positive connection to the grinding balls freely movable in the milling room defined by the milling container 2c. Practice has shown that a favorable rolling effect is achieved in this way. Although the agitator 3c of FIG. 5 has no tools other than the balls applied thereon, the construction of the agitator and the milling container 2c may be selected in any desired manner, for instance having rotor tools of a type known per se, however, with surfaces having a covering formed by such balls or hemispheres. For the purpose of manufacturing such surfaces, it is in principle conceivable that a layer of balls could be distributed over a portion of an inner surface of a milling container 2c, and then covered by pouring adhesive or soldering material over said layer. In any case, the excess of such binding material will be subsequently abraded away. Another way of manufacturing this layer may consist in producing and spreading a mixture of balls and adhesive over the surface, e.g., of the agitator 3c. This spreading can be effected in such a way that a layer of such a mixture is first formed on a flat, smooth (suitably slippery) underlayer formed by a flexible material onto which the adhesive adheres only badly. If necessary, a parting compound may be sprayed onto such an underlayer or sheet before the mixture of adhesive and balls is applied. The supporting film or sheet is then laid onto the outer surface of the agitator 3c or onto the inner surface of the milling container 2c to which the adhesive adheres, whereafter the supporting sheet is drawn off.

Having shown different kinds of drive means for the carousel shaft 64 as well as for the agitators of the agitator mills in FIGS. 3 to 5, FIG. 6 now shows a further modification of such drive means. In this embodiment, a common drive motor 33c is provided for all agitator mills (not shown) that may be mounted on the carousel shaft 64 in addition to the drive motor 88 for the carousel shaft 64. The drive motor 33c drives a hollow shaft 134 through a worm gear 133 or other gearing means. A crown wheel is provided on the upper end of the hollow shaft 134, forming a differential gear together with a further crown wheel 70b mounted on the carousel shaft 64 and with planetary gears 71 for the drive shafts 34c of the agitator mills which are connected thereto (see FIG. 3). Thus, the number of revolutions $n_R$ of the agitator of each agitator mill is calculated according to the following formula:

$$n_R = n_{KA} - n_{RA},$$

wherein $n_{KA}$ is the number of revolutions of the carousel drive and $n_{RA}$ is the number of revolutions of the agitator drive. This formula does not necessarily mean that the number of revolutions of the carousel has to be greater than the number of revolutions of the agitator, because the revolutions of the carousel may also be "negative" when the carousel is driven in the counterdirection. In many applications such a negative relationship will be appropriate.

From the foregoing, it will be evident that a change of the speed relationship of both drives may be desirable. This can either be effected by changing the rotational speed of at least one of the motors 33c or 88, which may be done by varying the current supply or the frequency of the a.c. supplied in accordance with the type of motor, as known per se, or by interconnecting at least one variable gear. A single motor 88 may drive the carousel shaft by means of such a variable gear either directly or through a first gearing, whereas the variable gear is interconnected between the motor and the drive for the hollow shaft 134. Alternatively, the motor may drive the hollow shaft 134 more or less directly, whereas the variable gear acts upon the carousel shaft 64.

Whereas, in the previously described embodiments, centrifugal force is used as the force acting substantially exclusively upon the attritive elements, FIG. 7 shows another construction wherein the attritive elements are moved by means of electro-magnets 135. In principle, the use of such a force acting only upon the attritive elements has become known from the U.S. Pat. No. 4,134,557, and the arrangement of the electro-magnets of the present FIG. 7 corresponds substantially to FIG. 9 of that U.S. patent. However, whereas in the known construction of the attritive elements, which are evidently of magnetically influenceable material, are brought in a circular path within the milling container by means of the electro-magnets, the circuit of FIG. 7 is such that the attritive elements (e.g., steel balls) are magnetically urged or moved opposite to the direction of flow of the product suspension.

Before describing in detail the circuit shown in FIG. 7, the pressure sensor 47 of this figure together with the indicating instrument 63 should be pointed out, which have already been described above. The supply and the discharge of the product to be ground is centrally effected through swivel joints mounted to the drive shaft for the agitator, as is known in principle from the Swiss Specification No. 132 086. In distinction to the known arrangement, the inlet separator device may be formed by an inlet tube 136 for the product, which extends nearly to the bottom 137 of the milling container **2*d* where it forms such a narrow gap that attritive elements are prevented from entering into the tube 136, on the one hand in consequence of their diameter, on the other hand because the intensive stream emanating from the narrow gap prevents them from entering the tube. If desired, the bottom 137 may be driven as an additional measure in the manner known from the French Specification No. 2 014753 or from the British Specification No. 2 074 895 whereby an additional separator effect is achieved in connection with the arrangement of the tube 136 as a consequence of the centrifugal force. Finally, it should be mentioned that the attritive elements will also have the tendency to remain at the inner wall of the milling container 2*d* due to the arrangement of the electro-magnets 135** outside the milling container.

Although the agitator is not represented in FIG. 7, it will be understood that it may be of any known type or may even be omitted by imparting also a rotational motion to the grinding balls in the manner known from the U.S. Pat. No. 4,134,557, cited above.

In order to energize the electro-magnets 135 in such a manner that they bias or move the attritive elements downwardly, and thus opposite to the stream of product flowing upwardly, an oscillator 138 is connected to a distributor or counter stage 139. With this arrangement, the pulses supplied by the oscillator 138 arrive one after another at the outputs n1 to n9 of the counter. As is evident, the agitator mill **1*d* may have another number of electro-magnets 135 from the top to the bottom, one output of the counter stage 139 being assigned to each one of the horizontally arranged rows of electro-magnets. In this way, the electro-magnets 135** are energized one after the other from the top to the bottom and draw the freely movable grinding balls downwardly in the manner of a linear motor.

Various facilities may be provided in the circuit of FIG. 7 for adjusting the efficacy of the electro-magnets 135 in accordance with the pressure indicated by the indicating instrument 63. For example, an operational amplifier 140 may be provided between the oscillator 138 and the counter stage 139. The amplification factor of the operational amplifier can be adjusted by any adjusting device 141. The adjustment device shown in FIG. 7 comprises an adjustment resistor. If necessary, instead of or additionally to the single central amplifier 140, each output n1 to n9 may have a separate adjustable amplifier. As a further adjustment measure, the frequency of the oscillator 138 may be varied, e.g., may be increased for biasing the attritive elements more frequently by the magnetic pulses. Such an adjustment device is indicated by an adjusting knob 142. It will be understood that the adjustment devices 141, 142 may also be included into a closed control loop in analogous manner to the arrangement of FIG. 2, where the adjustment devices 141 have to be adjusted in accordance with the output signal of the control stage 46. If one type of control should have the priority, then the amplitude of the magnetic pulses will generally be adjusted first by the adjustment device 141 before the frequency of the oscillator 138 is changed. However, both measures may be executed simultaneously if desired, as is also possible in the case of the control circuit of FIG. 2. As long as the pressure of the attritive elements measured by the pressure sensor 47 does not exceed a tolerable value, the oscillator 138 may either be disconnected from the counter stage 139 by means of a switch 143. Alternatively, a switch of this kind may be provided in the current supply to the oscillator 138. A further possibility is to have an interrupter additional to the switch 143 which may be useful, if the arrangement should need to be set out of operation if grinding balls of non-magnetic material are used.

Figure 10:
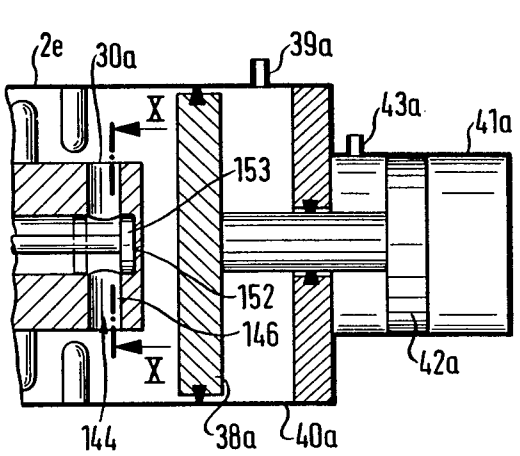
FIGS. 8–12 show different modifications of a separating device embodying the principle of invention, FIG. 10 being a section along the line X—X of FIGS. 8 and 9.
Figure 10:
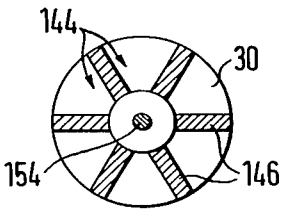
Figure 8:
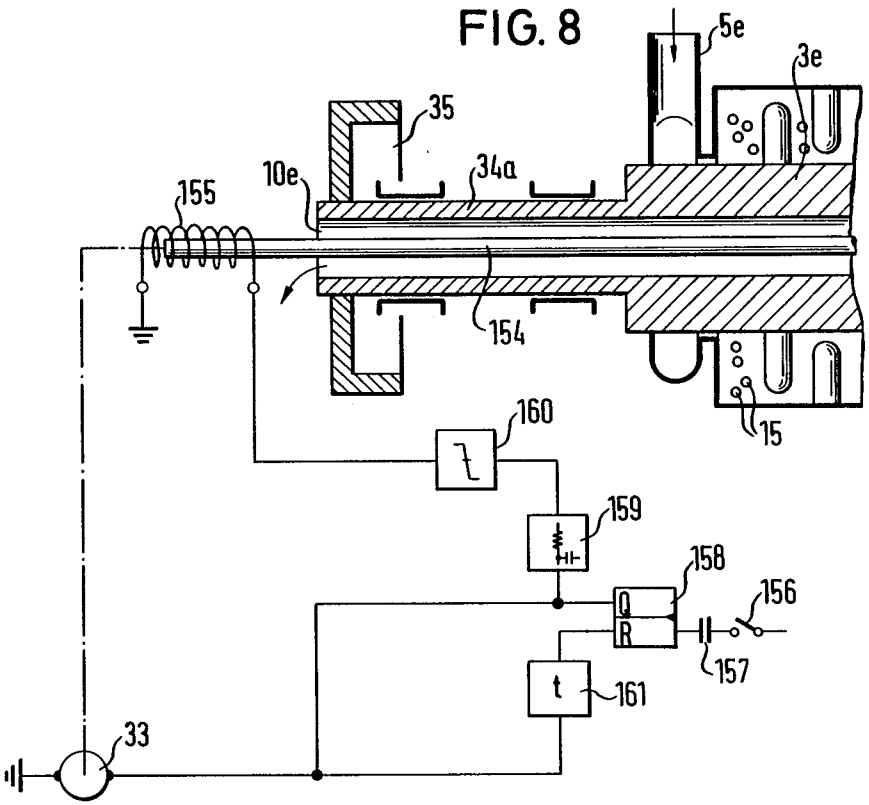
Figure 9:
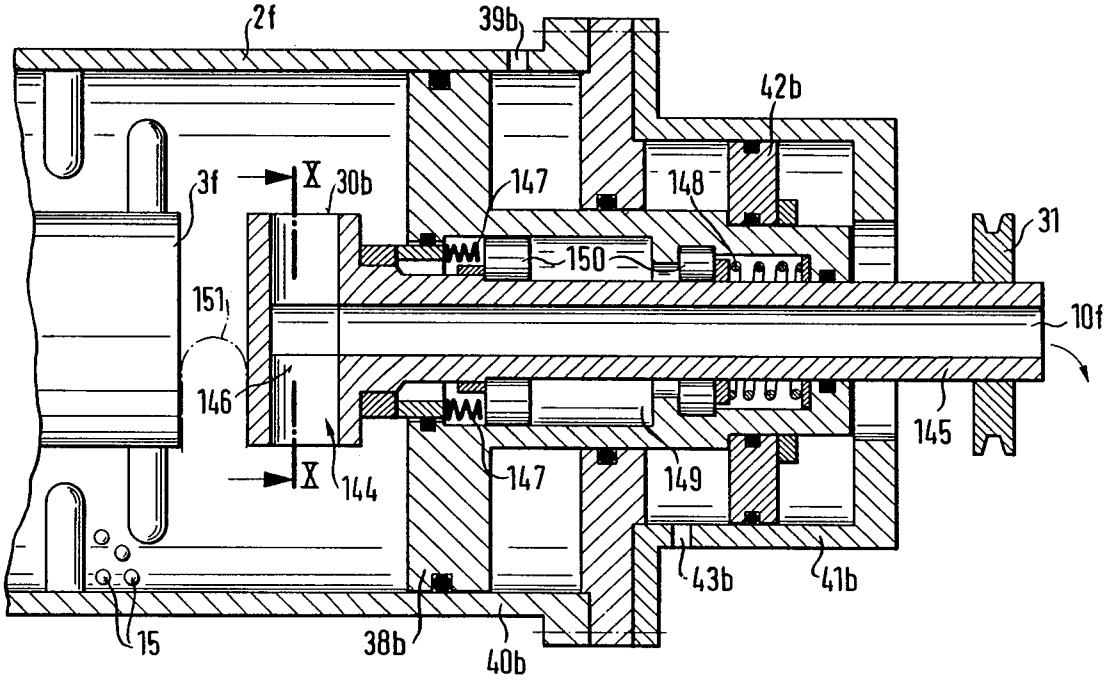

The FIGS. 8 to 10 illustrate two further modifications of the separator device 30, shown in FIG. 1, which acts by centrifugal force. In the technique proposed by DD-PS No. 140 656, a separator device has been used which acts by centrifugal force and has an opening of a cross-section greater than the diameter of attritive elements. However, this opening is defined only at one side by surfaces of the rotary body and, as already mentioned, the attritive elements are able to make a detour around this rotary body along the inner wall of the milling container so that they can arrive at the product outlet. In the present case, however, the opening 144 of the bucket wheel **30*a* (FIG. 8) or 30*b* (FIG. 9) is defined exclusively by walls of this rotary bucket wheel and it is impossible for the attritive elements 15 to escape the action of the centrifugal force, and the product separated from the attritive elements may be discharged via the hollow shaft 34*a* which also drives the bucket wheel 30*a*, or via the hollow shaft 145 provided for driving the bucket wheel 30*b***.

While in the embodiments shown the separator device is arranged at the outlets, the arrangement may also be used as an inlet separator device. This may clearly be imagined looking at FIG. 8 where the product inlet **5*e* in the case of an opposite flow of product would be the product outlet and the product would be supplied via the outlet opening 10*e* of FIG. 8**.

It is particularly advantageous if the bucket wheels **30*a* and 30*b* are arranged within the range of means varying the volume of and the pressure within the milling room comprising a piston 38*a* known per se. In the case of greater compactness of the accumulation of the attritive elements 15 (especially at the beginning of the operation), high braking forces would oppose the centrifugal force which effect may be influenced by the pressure varying device 38a to 43a to a certain degree. The pressure or volume varying device is, in principle, similarly constructed as is shown in FIG. 2** for axially adjusting the agitator, for which reason the same reference numerals are used, but with a letter added. A detailed description of this device, which is known per se, may therefore be omitted. It should merely be mentioned that the efficiency of the separation may be included as a control value in a possible control circuit for adjusting the volume of the milling room.

Since the efficiency of the separator device 30a acting by centrifugal force only increases gradually when the operation starts, and decreases when the agitator mill runs down, a closing unit is preferably provided for the product outlet 10e in order to prevent attritive elements from getting into the product outlet 10e during these two phases of the operation. To this end, a recess 152 is provided in the embodiment of FIG. 8 forming an extension of the longitudinal channel of the hollow shaft 34a. A thin closing piston 153 is housed in this recess during the normal operation so that its back surface is aligned with the inner surfaces of the bucket wheel, as shown. In this way, the flow of product is undisturbed by the piston 153 during the normal operation of the mill. However, during the starting phase or the runout phase, the piston 153 may be displaced into its position shown in dash-dotted lines, either manually or electrically by means of its piston rod 154, in which position the piston shuts the longitudinal channel extending through the hollow shaft 34a. If desired, the piston 153 may also be provided with slots or holes or may be rotated so that it acts as a normal separator device during these two phases of operation.

In order to actuate the piston 153 automatically, a switching circuit is provided, shown as a d.c.-circuit for the sake of simplicity, although normally a.c. current is used as the drive of an agitator mill. With this arrangement a circuit is interconnected with the circuit of the drive motor 33 and its corresponding closing switch 156 in such a manner, that the piston 153 is displaced into its dash-dotted position by an electro-magnet 155 each time before the motor 33 is switched out, and is displaced from the dash-dotted position some time after the motor is switched in. Therefore, when the switch 156 is closed, a coupling condenser 157 transmits a needle pulse to a trigger stage 158 that is energized at its output Q. This output Q is directly connected to the motor 33, and is also connected to the electro-magnet 155, but through an RC-circuit 159. The charge of this circuit exceeds the threshold value of a threshold switch 160 after a predetermined time whereafter the electro-magnet 155 is energized and the piston is displaced into its position shown in continuous lines. The time constant of the RC-circuit 159 is selected so that it corresponds reliably to any starting time of the agitator 3e that may occur. If desired, the timing circuit 159, 160 may be replaced by a tachometer energizing the electro-magnet 155 just when a predetermined nominal speed of revolution is attained.

However, when the switch 156 is opened, another needle pulse is produced at the output of the coupling condenser 157 whereby the trigger stage 158 is switched to the output R. In consequence, the electro-magnet 155 is deenergized and the piston 153 is displaced into its dash-dotted position under the tension force of a return spring (not shown). The output signal at the output R of the bistable trigger stage 158 triggers a monostable trigger stage 161 energizing the motor 33 in the period of its time constant before finally deenergizing it.

It will be understood that when using an alternating current motor for driving the mill, the time circuit and trigger stages may be connected as illustrated, however, not controlling the motor 33 directly but through suitable relays, contactors and magnetic control systems. If desired, it would also be possible to make the arrangement in the contrary manner where the piston 153 is in its dash-dotted position when the electro-magnet 155 is energized and returns under the action of a return spring into its position shown by coninuous lines. Furthermore, it is possible to energize the electro-magnet 155 during starting and running down only for a short time in order to close the product outlet 10e until the product pump has stopped.

If the bucket wheel 30, 30a or 30b with its bucket wheel walls 146 shown in FIG. 10 is situated within the range of the pressure or volume adjusting device 38a to 43a or 38b to 43b, a difficulty may arise, if—as in FIG. 1—a separate drive wheel 31 (see FIG. 9) has to be provided in order to achieve a different, especially higher, speed of revolution of this bucket wheel 30b relative to the speed of revolution of the agitator. In this case, it is advantageous, for the drive shaft 145 for the bucket wheel 30b to pass through the piston or pistons 38b, 42b and for it to be supported by the latter, for which purpose slide ring sealings biased by individual springs 147 or by a single helical spring 148 are preferably used, and for the space 149 illustrated between the two bearings to be filled by a sealing liquid under pressure which preferably has lubricating properties for the two bearings 150. To this end, the space 149 may be connected to a source of a pressure medium in a manner not shown.

Although the use of a bucket wheel is especially preferred for such a separator device acting by centrifugal force, the construction may also comprise other types of rotary bodies: the product outlet channel 10e or 10f may have a coaxial orifice within the milling room, said orifice being defined by walls of a disk or the like. Moreover, if the shaft 145 is supported in the manner shown in the FIG. 9, it is not necessary to drive the shaft 145 by the wheel 31, since instead of the wheel 31 also a driving connection 151 indicated by a dash-dotted line between the agitator 3f and the bucket wheel 30b may be provided. In this case, however, an axial displacement of the bucket wheel 30b relative to the agitator 3f has to be made possible, because the bucket wheel 30b is supported by the volume varying device 38b to 43b. Thus, a connection has to be chosen allowing such displacement. This connection may either be formed by bellows or by a positively driving telescoping shaft, similar to those driving connections being referenced in FIG. 2 by 44 and 45 or in FIG. 4 by 44a.

Numerous different embodiments are possible within the scope of the invention. For instance, in the embodiment of FIG. 5 the hoses 77b and 82b are, in fact, supported by a rod or other fastening 143 close to the pivot axis 129, but it will be understood that the variation of the length during pivoting of the agitator mill 1c will be the less the closer this rod 143 is mounted to the pivot axle 129, and it is also possible to replace the rod or hook 143 by the axle 129 itself, under the condition that the hoses 77b and 82 b cannot be damaged either mechanically or by the influence of heat when resting on the motor 33b or on the agitator mill 1c.

Furthermore, various combinations of individual features of the figures described above may be conceived. For instance, a drive motor corresponding to the embodiment of FIG. 4 may be mounted upon the carousel 64, 69 and may drive the carousel shaft 64 and the agitator shafts 34 through a planetary gear or a differential gear as in FIG. 6.

In the construction of the closing piston 153 of FIG. 8, it is possible that grinding balls may enter into the bucket wheel 30a while the piston 153 is in its position shown in dash-dotted lines. When such grinding balls arrive at the center of the bucket wheel during rotation of the agitator 3e at slow speed, the centrifugal force may be not high enough to expel these balls so that they may remain and may prevent the piston 153 from assuming its position shown in continuous lines at the next actuation. This is the reason why a construction is preferred, as illustrated in FIG. 11.

In this construction the agitator 3g is built up of individual rings as is described in the U.S. Pat. No. 4,174,074. In such a construction individual rings 162, 163 are seated on a tube 164, the outer surface of which serves as a reference surface for the rings 162, 163, said tube being supported on an inner tube 166 by radial ribs 165. Instead of the inner tube 166, flanges 166 in the form of tubular segments may be provided on the inner ends of the ribs 165, said flanges 166 surrounding in any case a piston tube 167 forming the product outlet channel 10g.

The piston tube 167 has a hollow piston 153a at its end, which is displaceable from the position shown in continuous lines into a dash-dotted position wherein the hollow piston 153a covers the ends of the walls 146 of the bucket wheel 30c. It may easily be understood that with such a construction the operating trouble described above will not occur, because even if the grinding balls should enter between the vanes 146 of the bucket wheel 30c, the cells of the bucket wheel 30c are shut off so far radially outwards that the centrifugal force is high enough to expel the grinding balls even with a low speed of rotation of the agitator 3g.

Figure 11:
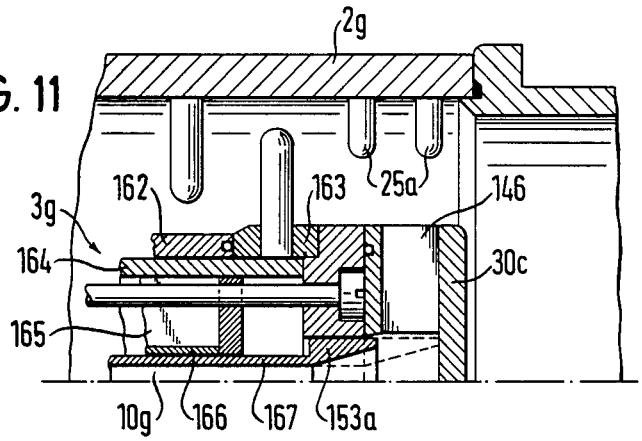

FIG. 11 also illustrates a way in which braking surfaces, for instance in the form of braking bars 25a, may be arranged radially outwardly of the bucket wheel 30c in order to prevent the grinding balls which are thrown out striking too hard against the inner wall of the milling container 2g. In the embodiment shown, the braking bars 25a are arranged in the radial direction with respect to the longitudinal axis (the dash-dotted line at the bottom of FIG. 11), but it is equally possible to provide braking bars extending in the axial direction.

Figure 12:
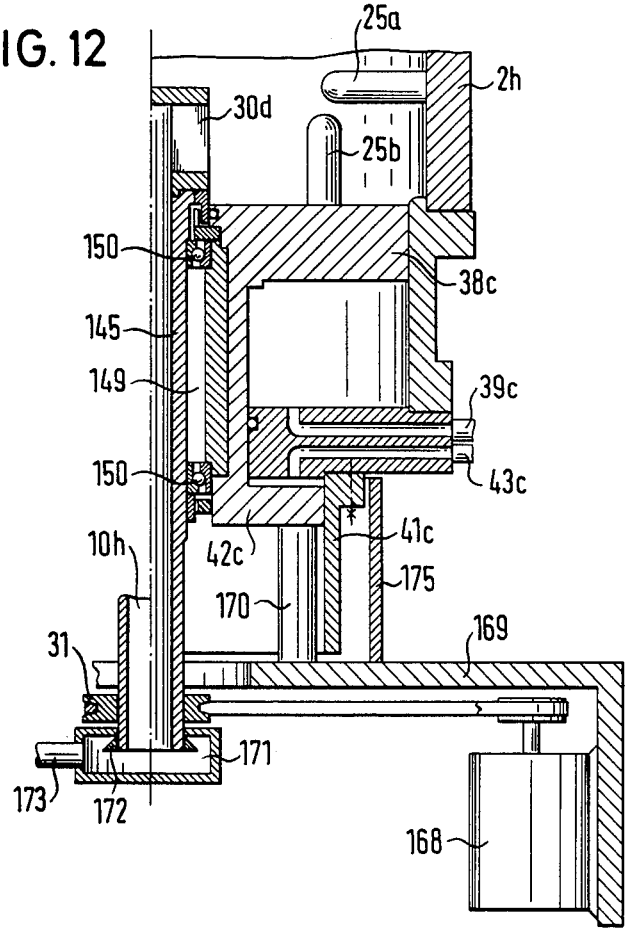

Such an axially extending braking bar 25b is shown in FIG. 12 being located radially outwardly of the bucket wheel 30d. If necessary, a radially extending bar 25a may be additionally provided. Similarly to the construction of FIG. 9, this separator device comprising the bucket wheel 30d is supported by a piston unit having two pistons 38c, 42c. The advantage of such a bearing arrangement resides especially in the fact that the separator device is independent of vibrations of the agitator. Hence, the adjustment of such separator devices may be more precise and is to a substantial extent independent of the construction of such rotary separator devices. This is particularly the case with the separator of FIG. 13 described later, wherein the width of a slot-like separator opening has to be exactly adjusted during assembly and maintained in operaton. Furthermore, the sealing problems are reduced because the sealing gaps may be more precisely determined and remain substantially unchanged during operation.

Although a problem may arise with respect to the drive of the separator device comprising the bucket wheel 30b (FIG. 9) or 30d ( FIG. 12), FIG. 12 shows how this problem may be solved. Since the pistons 38, 42c are displaced to and fro by the fluid conveyed over the channels 39c, 43c, a compensation for the movement has to be provided for the drive of the bucket wheel 30d. In principle, this can be effected so that the drive wheel 31 is axially displaceably connected to the hollow shaft 145 of the bucket wheel 30d, but positively connected thereto for common rotary movement, so that there is a kind of telescopic guidance. The drive wheel may be held in position relative to the moving shaft by lateral guide bearings.

However, in the embodiment of FIG. 12, the drive wheel 31 is fixed to the hollow shaft 145 in a manner not shown. In this case, it may be suitable to mount the motor 168 driving the shaft 145 onto a board or platform 169 moving together with the pistons 38c, 42c and being connected to piston 42c by means of columns 170. A similar problem may also arise at the orifice of the hollow shaft 145 suitably arranged within a splash chamber 171 and having a splash flange 172. Also in this case, a positive guide of the telescope-type may be provided. It is particularly advantageous if this telescopic guide is commonly provided for the splash chamber 171 and the drive wheel 31. Otherwise, the outlet tube 173 of such splash chamber 171 may be connected to a fixed conduit via a flexible hose.

It should be pointed out that tubular bodies 164 or 166 need not necessarily be used for centering the rings 162, 163, but it may be sufficient, in cases, to provide spoke-like radial walls 165 and to secure their respective angular position. Also, a sealing curtain or apron 175 may be provided around the cylinder 41c which is open at one end. Curtain 175 need not be used, but is favorable in some cases.

FIG. 13 illustrates how the bearing construction of a separator device having the usual separator disk 426 may be realized, said separator disk 426 having a drive shaft 245 and being supported within the piston 38d or the piston rod 415, respectively, by means of bearings 150. The type of the bearing construction corresponds substantially to that shown in preceding figures. However, a particular problem resides in the fact that the piston 38d has a cylindrical opening 413 forming an annular space. In principle, it would be possible to join a further coaxial annular space surrounding the shaft 245 and its bearings within the piston rod 415 to this annular space 413. In this case, the drive wheel 231 would be less accessible or additional sealings have to be provided.

Therefore, it is preferred to have a piston rod 415 of the cross-sectional shape shown in FIG. 13A, said piston rod 415 receiving the bearing construction for the drive shaft 415 within a central opening 176 whereas the product is discharged through an eccentrically arranged bore 177. Of course, constructions are also possible in which a plurality of such bores 177 are provided.

As already mentioned above, it is of advantage, particularly in the embodiment of FIG. 13, that the separating gap 178 is free from the vibrations and bending moments which would arise by mounting the disk on the agitator of the agitator mill, as in known constructions, especially since the width of this gap 178 between the piston 412 and the separator disk 426 is relatively critical. In this manner it is also possible to construct the piston arrangement without interfering with the separator device. If desired, it is also possible to superimpose a periodic axial displacement on the rotation of the separator disk 426 in the sense of a mere oscillation, in similar manner to that already proposed.

Whereas in a bucket wheel construction according to FIGS. 9 to 12, the drive separated from the agitator of the agitator mill has the advantage of enabling higher speeds of the bucket wheel 30*b* or 30*d* than the rotary speed of the agitator, the separator disk 426 will on the contrary normally be driven with a lower velocity. As a consequence, the wear on the wear rings 179 and 180 which define the separator gap 178 will be less. The drive for the separator disk 426 may be constructed in the same manner as described above. If necessary, a suitable step-down gearing may be interposed between the respective drive motor and the drive wheel 231. Furthermore, it should be mentioned that the separator disk 426 may be provided with tool-like ribs 21' on its front surface facing the milling room, if desired, such ribs 21' may not only develop an agitating effect (which is favorable for breaking down agglomerations), but may also assist in the separation by their centrifugal effect. In this case, the arrangement of braking bars 25*a* or 25*b*, respectively, as in FIG. 12 may be advantageous.

Numerous different modifications may be made within the scope of the invention. For instance, the separator disk according to FIG. 13 may be driven by a connection 151 to the agitator, as described with reference to FIG. 9. Moreover, the drive shaft 245 may also be hollow to discharge the product over a cross-bore connected to the annular opening 413. Instead of or additionally to the braking bars 25*a*, 25*b* enlarged smoothing spaces for the attritive elements 15 may be provided, as described above. Furthermore, the motor 168 may be replaced by a step-up gear or step-down gear, if desired, also by a variable speed gearing between the shaft 245 and the motor driving the agitator.

A variable speed gearing or a motor with a variable speed of revolution is particularly favorable for driving the buck wheel 30*b* or 30*d* in order to adapt their speed or centrifugal effect, respectively, to the special requirements (weight of the attritive elements, viscosity of the product and so on). It may also be advantageous to provide the bucket wheel 30 with easily exchangeable cell walls 146 (FIG. 10), because the same may be subjected to considerable wear. Hence, they should preferably consist of hard metal.

Figure 14:
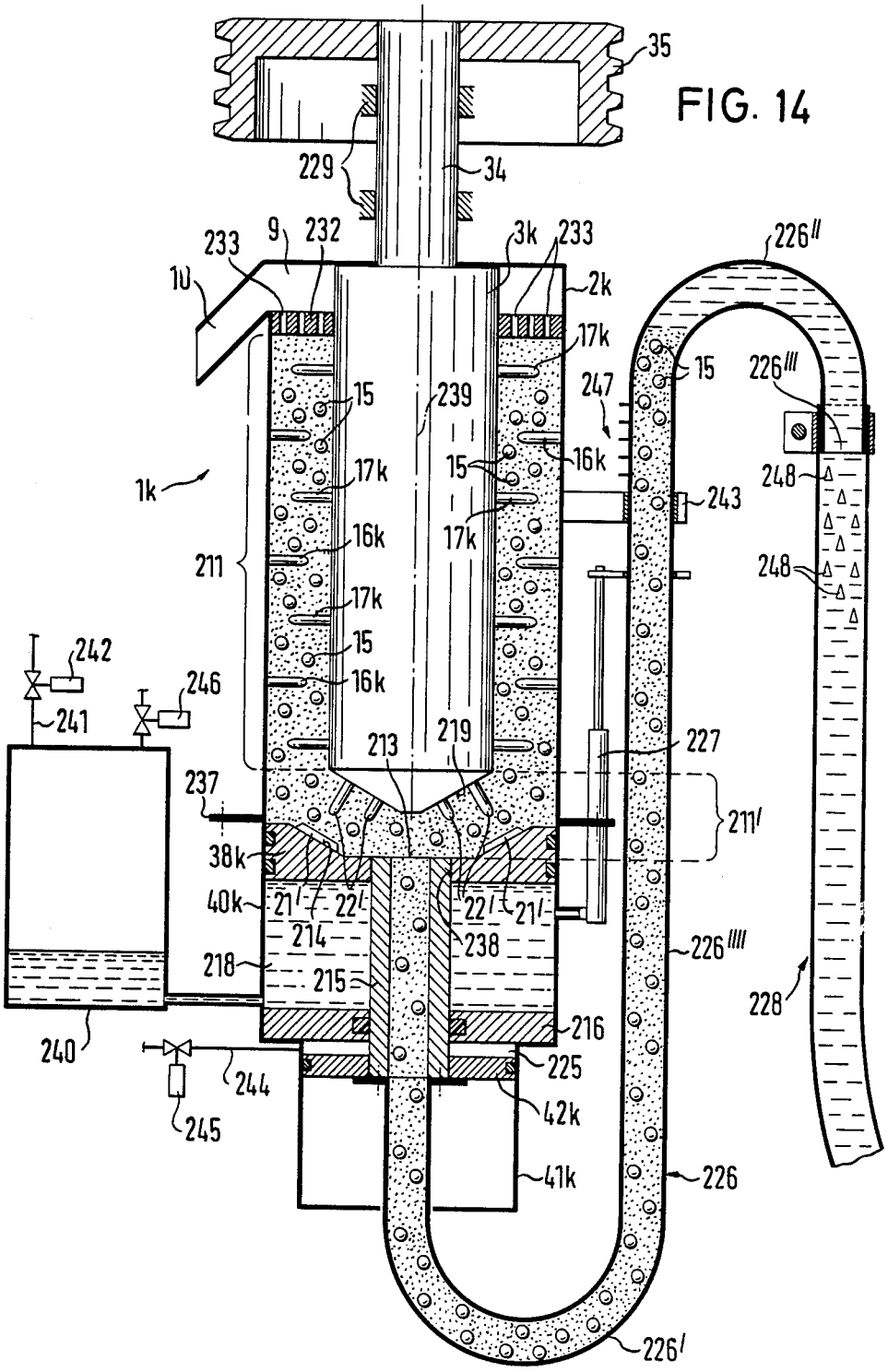
FIG. 14 is a modification of the construction of FIG. 1.

FIG. 14 illustrates that it may be advantageous to connect also other types of separator devices to the volume varying piston in view of the relatively large opening therein. In accordance with this embodiment, the cylindrical agitator 3*k* is concentrically arranged within a vertically upright cylindrical milling container 2*k* of an agitator mill 1*k* in similar manner to that shown in FIG. 1. The agitator 3*k* is journalled and supported at its upper end in an overhung position by bearings 229. Although this kind of bearing construction is preferred—on the one hand because it is less likely to cause the formation of lumps and on the other hand because in this way the arrangement of tools 21', 22' on the confronting surfaces 214, 219 of the piston 38*k* and of the agitator 3*k* is easier (these tools acting not only as milling tools but also counteracting the formation of lumps)—it is also easily possible to have a furhter bearing at the lower end of the agitator 3*k*, e.g., in the manner shown in U.S. Pat. No. 4,206,879.

The milling room 211 extending between the inner wall of the milling container 2*k* and the agitator 3*k* is closed by a sieve-like separator ring 232 having separator slots 233 through which the ground product may pass, but not the grinding balls 15 contained within the milling room 211. Above the separator ring 232 is the annular product outlet chamber 9 from which the product outlet 10 branches off.

Bar-like tools 17*k* are mounted on the cylindrical outer surface of the agitator 3*k*, said tools 17*k* extending into the milling room 211. Likewise, the stator tools 16*k* extend from the cylindrical inner wall of the milling container 2*k*, preferably axially offset with respect to the rotor tools 17*k* of the agitator 3*k*.

The milling container 2*k* in its lower range is formed as a cylinder 40*k* wherein the piston 38*k* is vertically displaceably arranged. The lower surface of the piston 38*k* is plane whereas the upper surface 214 preferably is raised to some extent towards the periphery of the piston. It is also preferred to construct the cylinder 40*k* as a separate unit which may be connected to the proper milling container 2*k* by means of flanges 237 and bolts only schematically illustrated by a dash-dotted line not referenced. The lower front surface 219 of the agitator 3*k* is suitably formed in the shape of a flat cone and has rotor tools 22' mounted thereon. Also, tools 21' are provided on the upper front surface 182 of the piston 38*k*, preferably in the region of the piston 38*k* and lying radially outwards.

The piston 38*k* is provided at its center with an orifice of a product inlet opening 213, which is preferably aligned with the upper front surface 214 in the central region of the piston and with the remaining portion of the channel extending through the piston rod 215, thus forming a tube. This tube 215 comprises the product inlet opening 213 and is inserted and fixed within a bore 238 of the piston 38*k* and extends along the axis 239 of the mill 1*k* in the opposite direction to the side of agitator 3*k*.

The tube 215 further extends slideably through the bottom 216 of the cylinder 40*k* where it is sealed, and communicates with the exterior of the mill 1*k* through the auxiliary piston 42*k* guided within a cylinder 41*k* secured to the bottoom 216. The piston 38*k*, the tubular pistion rod 215 and the auxiliary piston 42*k* are mounted so as to form a construction unit.

The space below the piston 38*k* is hermetically sealed against the exterior, and is filled with a hydraulic pressure oil supplied from a supply container 61*k* in which pressure oil is contained until a certain level. The surface or level of the pressure oil may be biased in the manner described with reference to FIG. 2 by pressure air supplied through a pressure air conduit 241 which is selectively connectable to the container 61*k* by means of a valve 242. The supply container 61*k* may be constructed and actuated as described with reference to FIG. 2. Between the bottom 216 and the piston 42*k* is a pressure space 225 which is also connectable to a source of pressure air (not shown) through a conduit 244 and a valve 245.

A separator device is connected to the lower orifice of the tube 215 in the form of a swan-neck tube 226 having a U-shaped secton 226' so that the tube bends upwardly and extends vertically upwardly outside the cylinder 41*k* parallel to axis 239 of the milling container 2k and to the side of the latter before turning downwardly at a further U-shaped bend 226''. This sector 226'' comprises the separator opening, since the grinding balls 15 being under the influence of the flow of product to the inlet orifice 213 cannot raise above the level of the milling room 211. A flexible hose is connected to the end 226''' of the swan-neck tube 226 for compensation of the displacement of the piston unit 38k, 42k, in case the swan-neck tube 226 is rigid, and slides up and down when the piston unit is displaced. Alternatively, the swan-neck tube 226 may be flexible itself, at least in its sector 226'. If the swan-neck tube 226 is rigid, an electrical or mechanical meter 227 is preferably provided for measuring and indicating the piston stroke. This piston stroke meter 227 may form part of a control circuit to replace the potentiometer 53 of FIG. 2 or a similar potentiometer described in the U.S. Pat. No. 4,303,205.

In the upper region of the vertical section 226'''' of the swan-neck tube 226, a slide guide 243 for the tube 226 is mounted to the container 17k and permits the vertical movement of the swan-neck tube 226.

By providing the product inlet at the bottom (orifice 213) and by providing the further tools 21', 22' the development of accumulation of attritive elements and product is prevented to a substantial extent and an additional partial milling room 211' is formed below the conical surface 219 of the agitator 3k.

The agitator mill 1k operates as follows:

When the operation of the mill 1k is terminated, the valve 245 is opened to set the space 225 under pressure. Thus, the piston 38k forming the proper bottom of the milling room 211, 211' is lowered. If necessary, the container 240 may be vented by opening a valve 246. When the piston 38k assumes its lowermost position, the packing density of the attritive elements 15 in the milling room 211 and particularly in the partial milling room 211' is at a minimum so as to prepare favorable conditions for starting the mill 1k anew.

Hence, the mill is started in the lowermost position of the piston 38k. In this way, starting is substantially facilitated. Having started the mill 1k, the piston 38k is moved upwardly by opening the valve 242 and, if necessary, by venting the pressure space 225. In case an accumulation of dried product and attritive elements had been formed during standstill of the mill, this accumulation would be broken up either by the action of the rotor tools 22' and the piston tools 21' in the bottom region of the milling container 2k or by the fresh fluid introduced through the orifice 213. By suitable control of the valve 242, the piston 38k may be displaced upwardly until it reaches a desired level.

In full load or normal operation of the mill 1k, a possible loss of attritive elements, particularly in consequence of the wear, may be balanced by a corresponding upwards displacement of the piston 38k. The swan-neck tube 226 may have a graduation 247, preferably within the range of the guide 243, so that the respective level of the piston 38k may easily be read out.

Since the bend 226'' comprising the separator opening of the swan-neck tube 226 is sufficiently above the sieve-like separator ring 233, the attritive elements 15 cannot enter the hose 228 even when the piston 38k is raised. On the other hand, granulated material 248 possibly introduced into the fluid supplied through the product hose 228 can more easily enter the milling room 211, 211', because an inlet slot or a relief valve, and thus an inlet opening of restricted cross-section, is avoided by the provision and use of the swan-neck tube 226.

Figure 15:
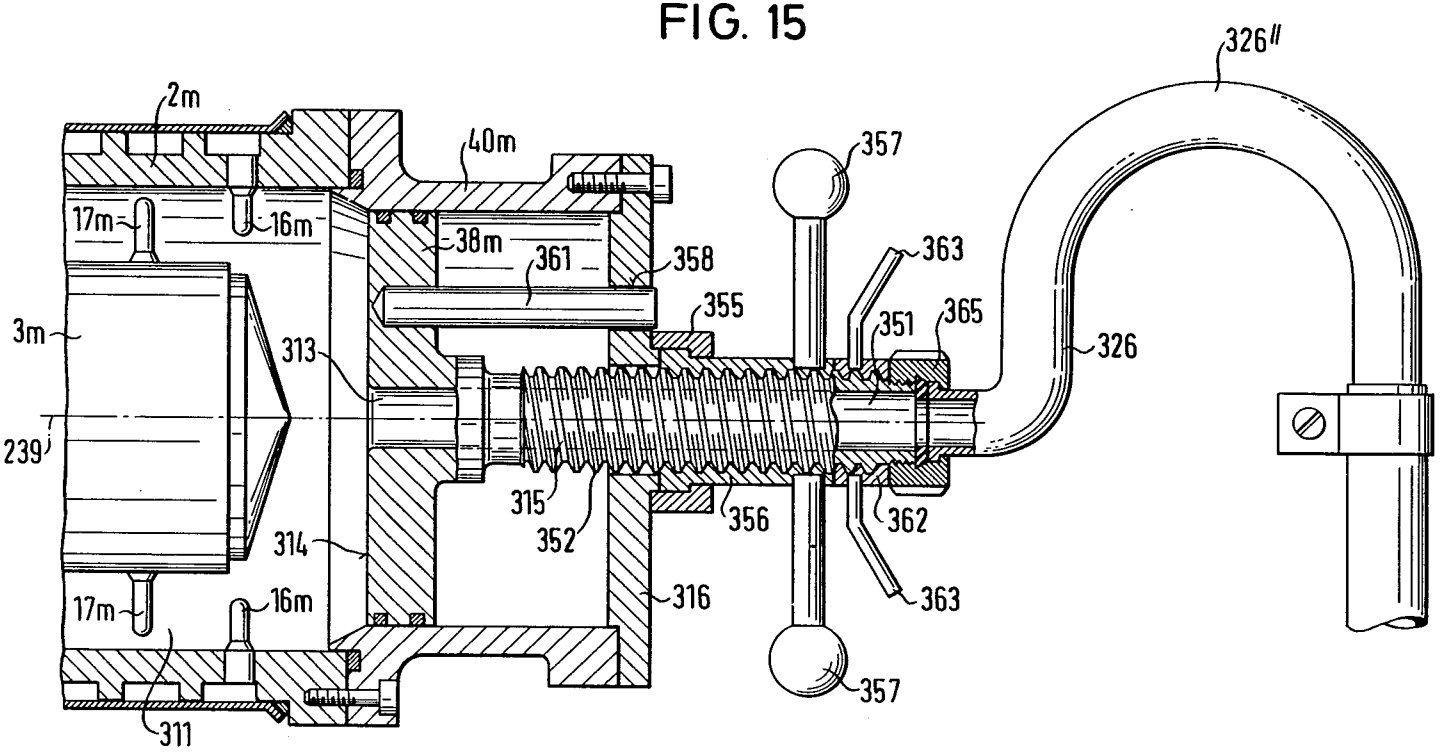

FIG. 15 shows another embodiment in which the milling room has a horizontal axis and its volume may be varied by hand, the parts not shown in FIG. 15, particularly in the region of the outlet, being constructed as in FIG. 14.

In accordance with FIG. 15, a cylindrical agitator 3m is concentrically arranged within the horizontal cylindrical milling container 2m, the agitator being supported only at one end in a manner not shown, but analogous to the arrangement of FIG. 14.

The agitator 3m has rotor tools 17m fixed to its cylindrical outer surface, the tools extending into the milling room 311. As before, stator tools 16m extend from the cylindrical inner surface of milling container 2k, preferably axially offset with respect to the rotor tools 17m of the agitator 3m.

A cylinder 40m is secured to the right side of the milling container 2m, a sealed piston 38m being axially displaceable within said cylinder 40m. The piston 38m has a central product inlet opening 313 discharging within the plane of the front surface 314 of the piston 38m, said surface 314 facing the agitator 3m. A tube-like piston rod 315 is mounted to the piston 38m and extends from the side opposite the agitator 3m. The opening or bore 351 of said tube 315 communicates with the orifice 313. An external thread 352 is provided on the outer surface of the tube 315 and extends into the cylinder 40m through an end plate 316 receiving said thread. The thread 352 is preferably a trapezoidal thread.

A supporting sleeve 355 is centrally mounted on the end plate 316 and axially secures a threaded bushing 356 having an internal thread which engages with the external thread 352 of the tube 315. Handles 357 are fixed to the threaded bushing 356, making it possible to turn the threaded bushing 356 in the support sleeve 355, thus axially displacing the tube 315 together with the piston 38m. Turning of the piston 38m and the tube 315 is prevented by a guide column 361 arranged parallel to the axis 239 of the mill, being secured to the piston 38m and axially displaceably guided within a guide bore 358 of the end plate 316. The respective axial position of the piston 38m is secured by tightening a lock nut 362 engaging the external thread 352 against the threaded bushing 356 by means of handles 363.

As in the foregoing embodiment, a swan-neck tube 326 is secured to that end of the tube 315, which faces away from the agitator 3m, by means of a nut 365. In this embodiment, a bended section 326'' of this swan-neck tube 326 also extends above the milling room 311.

Alternatively, a manual adjustment of the piston 38m may be effected in a similar way, as described in the German Specification No. 3 038 794 for adjusting the position of an agitator by means of an electric control signal which is introduced by means of a setting knob and is superimposed on an automatic control. Equally, a combination of an electric control and a mechanical adjustment may result in the length of the piston rod 215 (FIG. 14) being adjustable by way of a thread, whereas the electric control remains unchanged, thus possibly achieving the advantage that the switching or working points of the electric control can be maintained.

Figure 16:
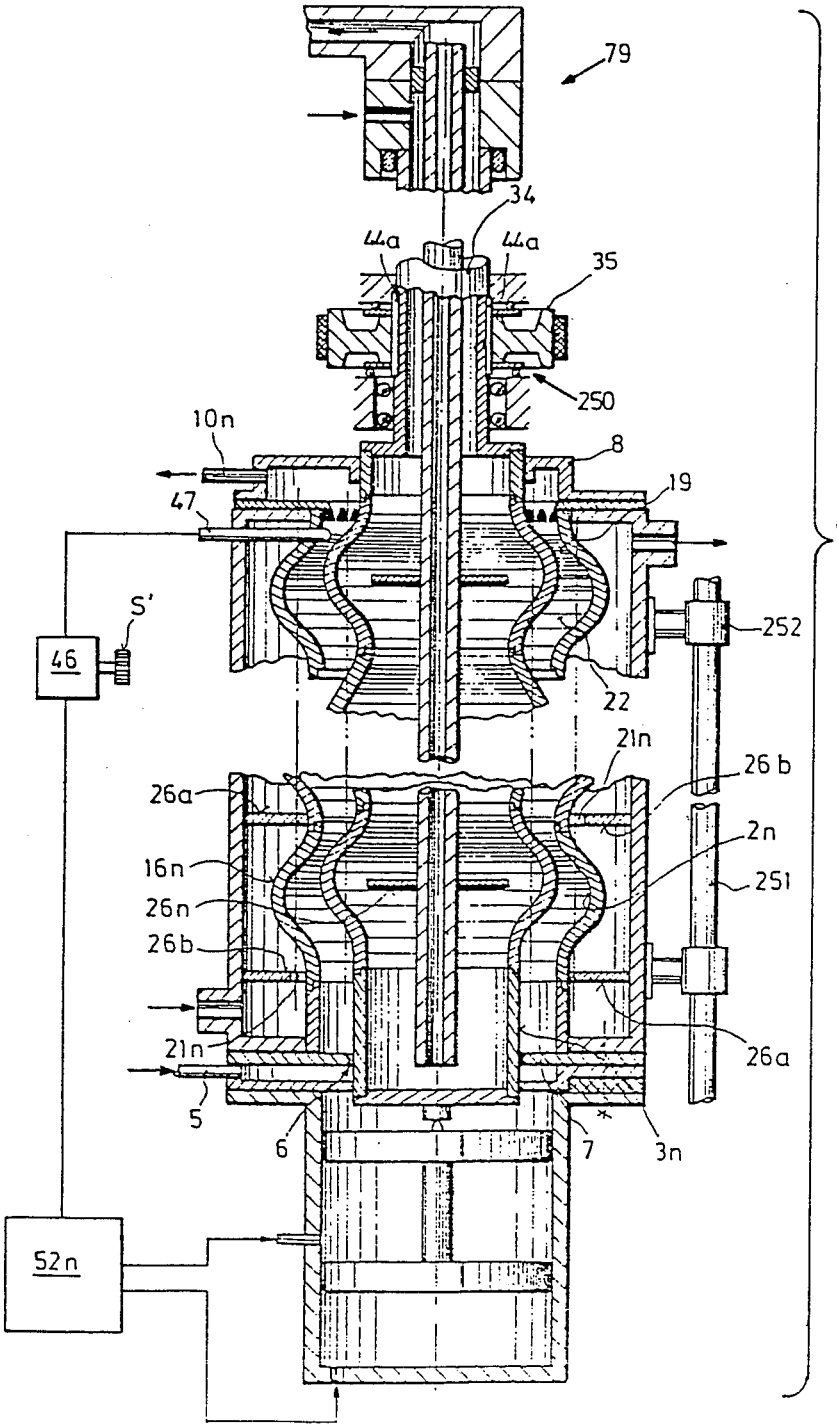
FIGS. 16 & 17A, 17B illustrate further modifications of the geometry of the agitator and stator in order to obtain similar effects as in the embodiment of FIG. 14.

FIG. 16 shows an embodiment functionally similar to that of FIG. 1, but with a modified geometry of the agitator and the milling container. Similarly to FIG. 2, the agitator is displaceable relative to the milling container. To this end, the drive wheel 35 may be positively, but axially displaceably, coupled to the shaft 34 by tooth-like projections 44a so that the axial position of the wheel 35 remains always unchanged in spite of any displacement of the shaft 34. For this purpose, a thrust bearing 250 may be provided, being only schematically illustrated.

As in FIG. 1, narrow room sections 19 will result in accordance with the position of the agitator 3n with respect to the inner wall of the milling container 2n and will subject the attritive elements to an increased centrifugal force. Smoothing room sections 22 will be created beneath the narrow room sections. Within the room sections 19 the centrifugal force acts in the opposite direction to the direction of flow of the product which is supplied through an inlet 5 at the bottom end and which enters the milling room between the milling container 2n and the agitator 3n through a separator gap 6.

As shown, it may again be appropriate to build up the cooperating areas of the milling container 2n and the agitator 3n from individual rings, particularly consisting of hard metal, provided with interengaging projections, as shown in FIG. 16. Similarly as in the embodiment of FIG. 1, a clamping bolt may be provided for clamping the individual rings together, as is known per se (which is why it has not been illustrated). Moreover, it will be advantageous to provide deviating elements within the interior of the agitator 3n for deviating the stream of cooling agent, such deviating elements being, for instance, formed by double-cones, but in the simplest case being formed by disks 26n in the manner shown in FIG. 16. Likewise, the milling container 2n in its cooling jacket may have a similar disk rings 26a, which have an additional supporting function for the individual rings in the case of the illustrated embodiment. To this end, radially extending arms 26b of the annular disks 26a engage the stator rings 16n leaving, respectively, an opening 21n for the passage of the flow of cooling medium as may clearly be seen, these openings 21n being offset relative to each other in adjacent disks 26a in order to force the cooling medium to deviate, thus improving the efficiency of cooling. Of course, a similar construction may also be provided for the rotor disks 26n.

The adjustment of the agitator is effected in a similar way as in the embodiment of FIG. 2 and comprises, if desired, also the pressure sensor 47. The nominal value may, for instance, be introduced into the control circuit 46 by an adjusting knob S'. The output signal of the control circuit 46 is then fed to a final control element 52n that, as can be seen, may not only correspond to the control valve 52 of FIG. 2, but may also comprise the remaining parts 58 to 62.

The advantage of the embodiment according to FIG. 16 resides in the fact that the outer diameter of the agitator 3n is only insignificantly smaller than the narrowest inner diameter of the milling container 2n whereby the difference in width may, in some cases, just correspond to the size of an attritive element. In accordance with the intended application, it may also be favorable to have a difference of diameters which is even smaller. By providing such dimensions, it is possible to detach the milling container 2n directly from the outlet casing 8 connected by connecting elements (not shown), such as screw bolts or the like, and to draw it off from the agitator 3n without disassembling the latter, as is necessary in the embodiment of FIG. 1. Since, however, the difference in diameter of the agitator and the milling container is very small, it may be advantageous, if the milling container 2n is guided by a linkage for tracing a straight line, e.g., in the form of a fixed guide column 251. Alternatively, the fixed portion comprising the bearings and the product outlet casing 8 may having connecting projections (or recesses) for mounting column-shaped rods passing through guide bosses 252.

It will be understood that instead of a wavy configuration (as seen in longitudinal section) a simple or double-cone construction may also be provided, in a similar way as is described in connection with the agitator of a mixer in the U.S. Pat. No. 4,175,871. In this way, an analogous flow will be obtained to that which has become known from this U.S. specification, especially, if a potential is applied between the milling container and the agitator.

Figure 17A:
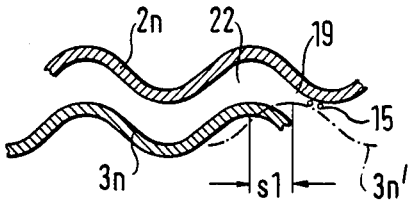
Figure 17B:
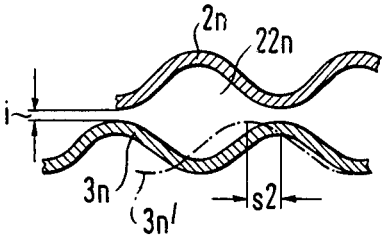

A further advantage of the embodiment described with reference to FIG. 16 will be seen by comparing the FIGS. 17A and 17B, showing the agitator and the milling container of a horizontally arranged agitator mill. For adjusting the width of the room sections 19 and 22, the rotor may be displaced (or vice-versa) relative to the milling container from the position shown in continuous lines to a dash-dotted position 3n' wherein the narrow section 19 is just wide enough to permit the passage of the attritive elements 15. Of course, in this position, the attritive elements 15 are subjected to a particularly high action of the centrifugal force within the room section 19, thus being thrown into the smoothing room section 22 opposite to the direction of flow of the product. The control stroke from the middle position into the dash-dotted position 3n' corresponds to a distance s1.

As in the embodiment of FIG. 16, there is a further control facility by displacing the rotor 3n or the milling container 2n in accordance with FIG. 17B from the position 3n' past the distance s1 by a further stroke s2 wherein they form individual chambers with each other. Advantageously, for such an application, the gap i between the maximum outer diameter of the agitator 3n and the minimum inner diameter of the milling container 2n is smaller than the diameter of the attritive elements 15 so that separator gaps are formed having a width i between the individual chambers 22n. Since, just in these ranges, considerable wear of the agitator and the milling container will occur, the construction from rings of hard metal according to FIG. 16 is particularly advantageous. By subdividing the milling room into individual chambers 22n the benefit is obtained that the pressure of the attritive elements, otherwise increasing towards the outlet, will be relatively small in correspondence with the restricted total volume of the attritive elements within one chamber 22n. Thus, a control effect is achieved by a relative displacement of milling container 2n and agitator 3n in correspondence with the stroke 2s.

From the foregoing explanations it will be seen that the range of application of the agitator mill will be enlarged by such a geometry of the milling room, because it is possible to control the agitator mill during the starting phase of the operation by a displacement starting from the position shown in continuous lines in FIG. 17A and terminating at the position shown in continuous lines in FIG. 17B. In this way the pressure of the attritive elements is low until the normal operating phase is attained, so as to provide an operation in which the individual chambers 22n are filled with grinding balls of different size (as compared in adjacent chambers 22n). To this end, each chamber 22n may have a separate inlet opening for filling in the attritive elements, and even a circulating operation may be provided for the grinding balls in which the attritive elements of each chamber are separated from the product outside of the respective chamber 22n. In this manner, a stepwise comminution is achieved, as has already been proposed. In this case, the control stroke applied according to FIG. 17B has been extended only so far that the attritive elements of one chamber are prevented from entering the adjacent chamber 22n. Which kind of control according to FIG. 17A and/or FIG. 17B is applied depends generally upon the product to be ground.

Figure 18:
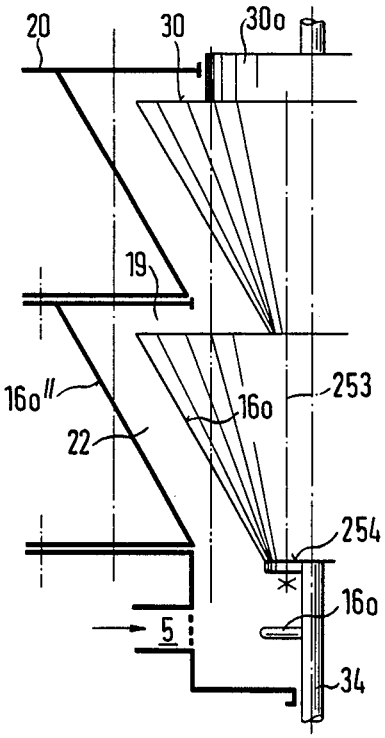
FIGS. 18, 19 illustrate further modifications of the geometry of the agitator and stator in order to obtain similar effects as in the embodiment of FIG. 16.
Figure 19:
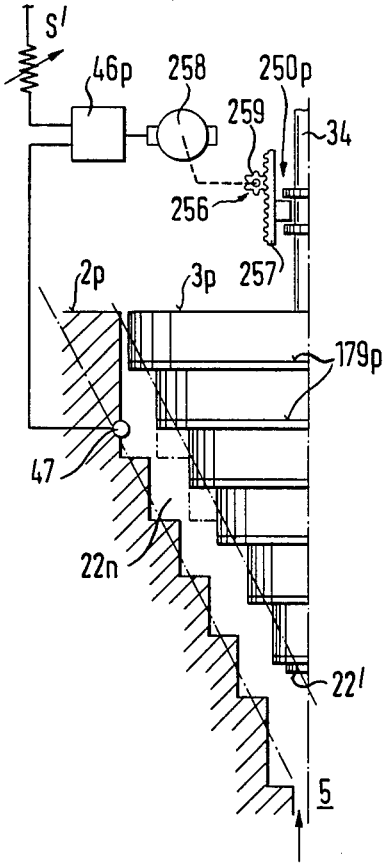

FIGS. 18 and 19 represent modifications of the geometry of the milling room wherein according to FIG. 18 the milling container 2o and the agitator 3o are respectively built up from individual cones or rings. This will again result in narrow and enlarged room sections 19 and 22, respectively, whereby the agitator 3o during starting operation may be lowered, if desired, so far that the width of the room section 22 is even smaller than that of the room section 19. By this measure, as in case rotor tools 16o are mounted on the agitator shaft 34, grinding balls accumulated at the bottom of the milling container 2o within the range of the inlet opening 5, which may be covered by a screen, are whirled up and are distributed over the whole milling room more quickly. In this manner, the starting phase may be shortened. Afterwards, during the normal operation, the width of the room sections 19 will be controlled in the manner described above.

Although in FIGS. 18 and 19, the individual parts are only roughly illustrated in order to represent exclusively the geometric configuration of the milling room, it will be understood that a suitable cooling for the milling container and the agitator will be provided analogously to the embodiments described before. Likewise, the milling container and the agitator may be built up of individual uniform rings as indicated by reference numerals 16o' and 16o'' in FIG. 18. A piercing clamping screw 253 may then extend from a cover plate 254 to a separator ring 30o and may be screwed into it, the separator ring 30o being relatively large in the axial direction in view of the displacement of the agitator.

By developing further the principle described with reference to FIG. 17B concerning the pressure control by subdividing selectively the milling room into individual chambers (which principle could also be realized by insertable horizontal partitions on the milling container), a construction may be used as represented in FIG. 19 wherein a double effect is achieved by a shouldered configuration having a general outline in form of a cone indicated by dash-dotted lines. Comparing FIGS. 18 and 19, it will easily be recognized that in the case of FIG. 18 the general outline indicated by dash-dotted lines forms a cylinder, but in both cases the inner surface of the milling container and the outer surface of the agitator form alternately projections and recesses with respect to the corresponding general outline.

By lifting the agitator 3p into its position shown by continuous lines, the volume of the milling room is enlarged in order to facilitate the starting phase of the mill and to maintain a constant power consumption of the drive for the agitator 3p. By changing over into the normal operation of the mill, the pressure of the attritive elements within the upper region of the milling container 2p schematically indicated will increase, which fact may be shown by a corresponding output signal of a pressure sensor 47. Additional operating parameters may influence a control circuit 46p in a manner known per se, the circuit 46p including also the final control elements.

Thus, when the normal operation phase is attained, the agitator 3p may be lowered into its position indicated by dash-dotted lines in which position the milling room is subdivided into individual chambers 22n as before. Since in this position the rims of the individual rings of the agitator 3p and the milling container 2p, respectively, are subjected to particularly high wear, these rims may be reinforced by inserting wear-resistant rings 179p which are, however, only indicated on the agitator 3p.

In the construction according to FIG. 19, the starting phase of the mill may, in some cases, be more difficult insofar as with the illustrated configuration the lowermost ring of the agitator 3p submerges into a relative narrow partial room of the milling container, in which the attritive elements can accumulate. However, the use of a swan-neck tube as an inlet separator device may be helpful as may the arrangement of rotor tools 22' (as in FIG. 14) on the lower front surface of the agitator 3p so that they may protrude axially therefrom. Since it has already been pointed out that the geometrical configuration of the milling room of FIG. 18 is particularly useful for facilitating the starting phase, a combination of the embodiments of FIGS. 18 and 19 will result in an optimum for most cases. In this combination, the lowermost ring or rings of an agitator 3p of FIG. 19 will be formed conically (in correspondence with FIG. 18) instead of cylindrically. Likewise, it is possible for the individual rings of the agitator to have a conicity which becomes steeper and steeper in the upward direction so that the angle of inclination of the outer surfaces of the rings will be the greatest at the lowermost end ring, and the uppermost ring of the agitator may be a cylinder. It may be favorable for the flow conditions, if at least the lowermost cone ring in such a construction is slightly concave suitably having the form of a flat cycloid in longitudinal section.

It has already been mentioned that a combination of the embodiment of FIGS. 18 and 19 or an exchange of individual features thereof is possible, and it is quite understandable that combinations with and of other embodiments described may also be used.

If, as in FIG. 19, the inlet opening 5 is on the bottom side of the milling container 2p and the agitator 3p has rotor tools 22' in this range, a displacement of the rotor may be advantageous by using an adjustment drive 256 acting on a thrust bearing 250 of the agitator shaft 34. In the embodiment shown, the adjustment drive 256 comprises a toothed rack 257 engaged by a motor pinion 259 driven by an electro-motor 258. It may be advantageous to have a symmetric arrangement in which the motor 258 drives two pinions 259 engaging respective racks 257 on two sides of the shaft 34. Furthermore, it may be favorable, if such adjustment drives for the constructions of FIGS. 16 to 19 or FIG. 2 have a certain elasticity, for instance to make it possible for attritive elements 15 which may become trapped when changing from the control of FIG. 17A to that of FIG. 17B, to move out of the way without damaging the adjustment drive. Such an elasticity is generally attained in the embodiment of FIG. 2 by the springiness of the gas 62. However, if desired, any type of spring may also be provided within the mechanical portion of the transmission path, or a pneumatic adjustment may be used instead of a hydraulic one.

In cases in which a displacement of a piston for varying the volume or the density of the attritive elements, respectively, is to be provided in addition to the adjustment of the agitator (see FIG. 2), two piston units may be connected in series. For instance, the piston rod of the piston varying the volume of the milling room may be hollow and comprise the piston rod for adjusting the agitator. Although, the formation of individual chambers according to FIG. 19 functions without using centrifugal force, the pressure of the attritive elements is also reduced in this construction.

What I claim is:

1. An agitator mill, comprising:

a milling container surrounding a milling chamber and having first and second axially spaced apart ends;

an agitator extending into said milling chamber and being supported within said milling container for rotation about an axis, said agitator having a drive end adjacent said first end of said container and a separator end disposed adjacent said second end of said container;

drive means for rotatably driving said agitator;

a plurality of attritive elements in said milling chamber, said attritive elements having a predetermined maximum size;

inlet means on said container adjacent said first end for the entry into said milling chamber of a product to be ground, said product being suspended in a liquid;

outlet means comprising a hollow bore extending within said agitator from said separator end to said drive end;

wherein said separator end of said agitator comprises at least one radially extending passage connecting said milling chamber to said hollow bore; and wherein said at least one radially extending passage is bounded exclusively by rotatable wall means and has a cross-section greater than said predetermined maximum size of said attritive elements.

2. An agitator mill as claimed in claim 1, and further comprising:

a closure member disposed in said hollow bore; and means for moving said closure member between a first open position on a side of said at least one radially extending passage remote from said drive end, whereby said product can flow into said hollow bore, and a second closed position on the drive end side of said at least one radially extending passage in which said closure member closes said hollow bore.

3. An agitator mill as claimed in claim 1, wherein said hollow bore is defined within a shaft mounted for restricted axial movement inside said agitator between an advanced closed position in which wall means of said shaft obscure said at least one radial passage and a retracted open position in which said product can flow through said at least one radial passage into said hollow bore.

4. An agitator mill, comprises:

a milling container surrounding a milling chamber;

agitator means extending into said milling chamber, said agitator means being supported within said milling container for rotation about an axis;

drive means for rotatably driving said agitator means for milling operation;

inlet means on said milling container providing a passage for a product to be ground suspended in a fluid;

outlet means on said milling container for said product suspended in said fluid flowing from said inlet means along a predetermined path of flow through said milling chamber;

a plurality of attritive elements within said milling room to be agitated by said agitator means and to grind said product;

separating means adjacent said outlet means for retaining said attritive elements within said milling chamber; while providing at least one opening permitting the passage of said product through said separating means to said outlet means;

first disk-like surfaces extending radially outwards from said agitator means; and second disk-like surfaces extending radially inwards from said milling container;

wherein said first and second disk-like surfaces overlap in the radial direction to provide said path of flow with at least one of each of radially inwards and outwards leading sections, said first surfaces exerting a centrifugal force during their rotation onto said attritive elements, and wherein each inwards leading section has a greater width measured normally to the direction of path of flow than each said outward leading section, at least during part of said milling operation, whereby to reduce the action of said centrifugal force in relation to the action thereof within each outwards leading section.

5. An agitator mill as claimed in claim 4, further comprising adjusting means for varying the action of said centrifugal force in each said radially inwards leading section relative to the action of said centrifugal force in each said radially outwards leading section.

6. An agitator mill as claimed in claim 5, wherein said adjusting means comprise position varying means operatively connected to said agitator means in order to displace the same.

7. An agitator mill as claimed in claim 5, wherein said adjusting means comprise pressure sensitive means within said milling-chamber for sensing the pressure exerted by said attritive elements and for providing a corresponding output signal;

control circuit means receiving said output signal for forming an adjustment signal; and regulating means for adjusting said relationship in dependency upon said adjustment signal.

8. An agitator mill as claimed in claim 5, wherein said drive means comprise speed varying means, said adjusting means being operatively connected to said speed varying means in order to control the same.

9. An agitator mill, comprising:

a milling container surrounding a milling chamber;

agitator means extending into said milling chamber and having an axis of rotation;

drive means for rotatably driving said agitator means about said axis of rotation for milling operation;

inlet means on said milling container providing a passage for a product to be ground suspended in a fluid;

outlet means on said milling container for said product suspended in said fluid flowing from said inlet means along a predetermined path of flow through said milling chamber;

a plurality of attritive elements within said milling chamber to be agitated by said agitator means and to grind said product;

separating means adjacent said outlet means for retaining said attritive elements within said milling chamber, while providing at least one opening permitting the passage of said product through said separating means to said outlet means;

means providing an axis of rotation for said milling container outside the same, with said axis of rotation for said container being disposed at an angle relative to said axis of rotation of said agitator means, at least during milling operation; and rotating means for rotating said milling container about its axis of rotation;

wherein said inlet means are arranged radially outward with respect to said outlet means and with respect to said axis of rotation of said milling container, whereby to generate a centrifugal force which is opposite to at least a portion of said path of flow.

10. An agitator mill as claimed in claim 9, further comprising:

water supply means having at least one orifice arranged above said path of rotation;

collecting launder means annularly surrounding said axis of rotation in a plane below said orifice;

water jacket means on said milling container;

and conduit means interconnecting said launder means and said water jacket means.

11. An agitator mill as claimed in claim 9, further comprising:

means providing automatic balancing during rotation of said milling container about its axis of rotation, said automatic balancing means including adjustable counterweight means; and negative feedback means for the automatic adjustment of said counter-weight means.

12. An agitator mill as claimed in claim 7, wherein said milling container has substantially the shape of a truncated cone having a basal plane and a cover plane as well as a conical surface extending between said planes, said basal plane being disposed radially outwards and said cover plane being disposed radially inwards with respect to said axis of rotation of said milling container.

13. An agitator mill as claimed in claim 9, further comprising cooling conduit means helically arranged around said milling container.

14. An agitator mill as claimed in claim 9, and comprising a plurality of said milling containers rotatable about a common axis of rotation defined by carousel shaft means;

wherein said carousel shaft means drives said milling containers about said common axis of rotation and has at least one bore extending at least over part of its length for conducting a fluid; and further including:

fluid conductive swivel joint means on said carousel shaft means.

15. An agitator mill as claimed in claim 14, wherein said swivel joint means is in fluid conducting relationship with at least one of said inlet means and said outlet means of said plurality of milling containers.

16. An agitator mill as claimed in claim 14, wherein said carousel shaft means are substantially vertically arranged.

17. An agitator mill as claimed in claim 14, further comprising:

first fluid conductive connecting means for providing a fluid connection between said inlet means of said plurality of milling containers; and second fluid conductive connecting means providing a fluid connection between said outlet means of said plurality of milling containers.

18. An agitator mill as claimed in claim 17, wherein said first fluid conductive connecting means comprise valve means for selectively interconnecting said plurality of milling containers in parallel and in series.

19. An agitator mill as claimed in claim 14, means for pivotally mounting said plurality of milling containers on said carousel shaft means.

20. An agitator mill as claimed in claim 9, wherein said means defining said axis of rotation comprises a carousel shaft arranged to drive said milling container about its axis of rotation; and wherein said drive means are arranged opposite to said milling container with respect to said carousel shaft means.

21. An agitator mill as claimed in claim 20, further comprising:

planetary gear means interconnected between said drive means, said agitator means and said carousel shaft means.

22. An agitator mill as claimed in claim 21, wherein said planetary gear means comprise a differential gear.

23. An agitator mill as claimed in claim 14, further comprising:

elastic bearing means for said carousel shaft means for enabling a tumbler movement as a consequence of an imbalance.

24. An agitator mill, which comprises:

a milling container surrounding a milling chamber;

agitator means extending into said milling chamber, said agitator means being supported within said milling container for rotation about an axis;

drive means including a shaft for rotatably driving said agitator means;

inlet means on said milling container providing a passage for the entry into said milling chamber of a product to be ground suspended in a fluid;

a plurality of free attritive elements within said milling chamber to be agitated by said agitator means and to grind said product, said attritive elements having a predetermined maximum size;

outlet means on said milling container providing a passage for the exit from said milling chamber of the product suspended in said fluid, after grinding; and rotary separator means disposed adjacent one of said inlet or outlet means for permitting the flow of the ground product therethrough, while preventing passage of said attritive elements therethrough and out of said milling chamber;

said separator means comprising a rotatable hub disposed coaxial to said shaft, the hub including at least one through passage having a cross section greater throughout its length than the predetermined maximum size of said attritive elements and having a portion which extends substantially radially inwardly from said milling chamber to said adjacent inlet or outlet means, in direct fluid communication therebetween, and which passage is bounded on all sides by wall means of said hub, and means for rotating said hub independently of said agitator means to generate a centrifugal force directed radially outwardly along said passage and acting in a selective manner substantially only upon said attritive elements.

25. An agitator mill as claimed in claim 24, further comprising:

means for varying the volume of said milling chamber including a movable piston having a front surface defining partly said milling chamber, said piston being disposed in said milling container opposite said separator means.

26. An agitator mill, comprising:

a milling container surrounding a milling chamber;

agitator means extending into said milling chamber;

drive means including a shaft for rotatably driving said agitator means;

inlet passage means on said milling container providing a passage for the entry into said milling chamber of a product to be ground suspended in a fluid;

outlet passage means on said milling container for said product suspended in said fluid;

a plurality of attritive elements within said milling chamber to be agitated by said agitator means and to grind said product, said attritive elements having a predetermined maximum size;

a separator disposed adjacent one of said inlet or outlet passage means for retaining said attritive elements within said milling chamber, while permitting flow of the product, through said passage means while preventing flow of said attritive elements through said passage means;

said separator comprising a hub disposed coaxial to said shaft, at least one passage formed in said hub, said passage having a cross section greater than a predetermined maximum size of said attritive elements and a portion which extends substantially inward from said milling chamber to said passage means and is bounded on all sides by wall means of said hub, and means for rotating said hub independently of said shaft to generate a centrifugal force directly radially outward along said passage and acting in a selective manner substantially only upon said attritive elements; and smoothing means arranged within the range of said separator for smoothing the movement of the attritive elements being under the action of said centrifugal force.

27. An agitator mill as claimed in claim 26, wherein said smoothing means comprise braking means radially outside of said separator.

28. An agitator mill as claimed in claim 26, wherein said smoothing means comprise a free space surrounding at least partly said separator.

29. An agitator mill, comprising:

a milling container surrounding a milling chamber;

agitator means extending into said milling chamber, said agitator means being supported within said milling container for rotation about an axis;

drive means for rotatably driving said agitator means for milling operation;

inlet means on said milling container providing a passage for a product to be ground suspended in a fluid;

outlet means on said milling container for said product suspended in said fluid flowing from said inlet means along a predetermined path of flow through said milling chamber;

a plurality of attritive elements within said milling chamber to be agitated by said agitator means and to grind said product;

separating means adjacent said outlet means for retaining said attritive elements within said milling chamber, while providing at least one opening permitting the passage of said product through said separating means to said outlet means;

first disk-like surfaces extending radially outwards from said agitator means; and second disk-like surfaces extending radially inwards from said milling container;

said first and second disk-like surfaces cooperating to define at least one radially inward leading section in which said path of flow is directed radially inward towards the axis of rotation of said agitator means, and at least one radially outward leading section in which said path of flow is directed radially outward from said axis of rotation of said agitator means, and wherein means is provided for increasing the effect of the centrifugal force acting on the milled material and on the attritive elements in said radially inward leading section relative to the effect in said radially outward leading section.

30. An agitator mill as claimed in claim 29, further comprising brake means provided within at least one said outwards leading section for reducing the action of said centrifugal force.

31. An agitator mill as claimed in claim 30, wherein said brake means comprise at least one braking stud extending across the width of the respective outwards leading section for braking said attritive elements being under the action of said centrifugal force.

32. An agitator mill as claimed in claim 29, wherein said separating means comprises a rotatable hub having axially extending passage means leading to said outlet means and at least one radially extending passage communicating with said axially extending passage means, said at least one radially extending passage being bounded exclusively by wall means of said rotatable hub and having a cross-section greater than a predetermined maximum size of said attritive elements, and wherein product leaving said milling chamber flows radially inwards along said at least one passage into said axially extending means.

33. An agitator mill as claimed in claim 32, wherein said rotatable hub is disposed coaxially of said drive means and is rotatable independently thereof.

34. An agitator mill, comprising:

a milling container surrounding a milling chamber and having first and second axially spaced apart ends;

an agitator extending into said milling chamber and being supported within said milling container for rotation about an axis, said agitator having a drive end adjacent the first end of said milling container and another end adjacent the second end of said milling container;

drive means for rotatably driving said agitator;

a plurality of free attritive elements in said milling chamber, said attritive elements having a predetermined maximum size;

inlet means for the entry into said milling chamber of a product to be ground, said product being suspended in a liquid;

means for varying the volume of said milling chamber including a movable piston having a front surface adjoining said milling chamber, said piston being disposed at said second end of said milling container;

a rotary outlet separator rotationally journalled in the piston of said variable volume means; and drive means for rotating said outlet separator independently of said agitator drive means;

wherein said rotary outlet separator comprises a hub member having a generally longitudinal passage extending through it to define outlet means for discharging the suspended product after grinding and, inside said milling chamber, at least one generally radial passage finally connecting said milling chamber to said longitudinal passage, with said at least one radial passage being bounded solely by rotatable wall means of said separator and having a cross-section greater than the predetermined maximum size of said attritive elements in order to permit flow of the ground product while centrifugally preventing passage of the attritive elements through the outlet means.

* * * * *